US009707788B2

(12) United States Patent
Kung et al.

(10) Patent No.: US 9,707,788 B2
(45) **Date of Patent: *Jul. 18, 2017**

(54) CONDUCTIVE THERMAL IMAGING RECEIVING LAYER WITH RECEIVER OVERCOAT LAYER

(71) Applicant: Kodak Alaris Inc., Rochester, NY (US)

(72) Inventors: Teh-Ming Kung, Rochester, NY (US); Kathleen Bonsignore, Rochester, NY (US); Renee L. Daniels, Rochester, NY (US); Lianne Heath, Rochester, NY (US); John P. Olscamp, Rochester, NY (US); Kim Standish, Rochester, NY (US); Ellen L. Bennett, Rochester, NY (US); Peter J. Ghyzel, Rochester, NY (US); Joseph F. Janinek, Rochester, NY (US); John L. Muehlbauer, Rochester, NY (US); Walter E. Scott, Rochester, NY (US)

(73) Assignee: KODAK ALARIS, INC., Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/142,972

(22) Filed: Apr. 29, 2016

(65) Prior Publication Data

US 2016/0243868 A1 Aug. 25, 2016

Related U.S. Application Data

(63) Continuation-in-part of application No. 14/599,607, filed on Jan. 19, 2015, now Pat. No. 9,440,473, which (Continued)

(51) Int. Cl.
*B41M 5/44* (2006.01)
*B41M 5/52* (2006.01)

(52) U.S. Cl.
CPC ..... *B41M 5/44* (2013.01); *B41M 5/52* (2013.01); *B41M 5/5254* (2013.01); (Continued)

(58) Field of Classification Search
CPC .... B41M 5/44; B41M 5/5254; B41M 5/5272; B41M 2205/02; B41M 2205/32; B41M 2205/38; B41M 2205/40
(Continued)

(56) References Cited

U.S. PATENT DOCUMENTS 6,410,199 B1 6/2002 Ikeuchi et al.
8,404,332 B2 * 3/2013 Majumdar ..... B41M 5/5281 428/195.1
(Continued)

FOREIGN PATENT DOCUMENTS

EP 1623840 A1 2/2006
EP 2000319 A2 12/2008
(Continued)

OTHER PUBLICATIONS

Written Opinion and International Search Report dated May 3, 2016 in corresponding Patent Cooperation Treaty patent application No. PCT/US2016/013626.
(Continued)

*Primary Examiner* — Bruce H Hess
(74) *Attorney, Agent, or Firm* — Hogan Lovells US, LLP

(57) ABSTRACT

This invention relates to a conductive thermal image receiver element that has an aqueous coatable dye-receiving layer and an aqueous coatable receiver overcoat layer. The receiver overcoat layer comprises a conductive polymeric material and a two or more dispersants. The dye-receiving layer comprises a water-dispersible release agent, a cross-linking agent, and a polymer binder matrix consisting essentially of a water-dispersible polyester and a water-dispers-
(Continued)

2-Layer DRL or ROC/DRL ible acrylic polymer. This invention also relates to a method for making this thermal image receiver element as well as method for using it to provide a dye image by thermal transfer from a donor element.

19 Claims, 8 Drawing Sheets

Related U.S. Application Data is a continuation-in-part of application No. 14/560,937, filed on Dec. 4, 2014, now Pat. No. 9,365,067.

(60) Provisional application No. 61/977,361, filed on Apr. 9, 2014, provisional application No. 61/913,262, filed on Dec. 7, 2013, provisional application No. 62/155,906, filed on May 1, 2015.

(52) U.S. Cl.
CPC ..... *B41M 5/5272* (2013.01); *B41M 2205/02* (2013.01); *B41M 2205/32* (2013.01); *B41M 2205/34* (2013.01); *B41M 2205/38* (2013.01); *B41M 2205/40* (2013.01)

(58) Field of Classification Search
USPC ..... 503/227; 428/32.39
See application file for complete search history.

(56) References Cited

U.S. PATENT DOCUMENTS

| | | | |
|---|---|---|---|
| 2003/0025106 A1 | 2/2003 | Schwark et al. | |
| 2004/0135126 A1 | 7/2004 | Schwark et al. | |
| 2011/0027505 A1 | 2/2011 | Majumdar et al. | |

FOREIGN PATENT DOCUMENTS

| | | | | |
|---|---|---|---|---|
| WO | WO 2008/042631 | * | 4/2008 | ..... B41M 5/00 |
| WO | 2013/184396 | | 12/2013 | |
| WO | 2014/168784 | | 10/2014 | |

OTHER PUBLICATIONS

International Search Report mailed May 8, 2016 in International Application No. PCT/US2016/030196.
International Preliminary Report on Patentability mailed Oct. 12, 2016 in International Application No. PCT/US2015/011886.

* cited by examiner

Single Layer DRL

2-Layer DRL or ROC/DRL

FIG. 2

| Dispersion ID# | Single Layer Approach | | | | | | | | | | | | | |
|---|---|---|---|---|---|---|---|---|---|---|---|---|---|---|
| | ROC (receiver overcoat) | | DRL (dye-receiving layer) | | Sub Layers | | Total PEDOT mg/ft^2 | PEDOT conc. mg/cc | SER log Ω/square @70F/50%RH Face | Buckling/ Creasing at Max Donor Printing | White Dropouts or Spots | Image Bleed 1WK @ 35C/50% | Image Bleed 1WK @ 40C/50% | Image Bleed 1WK @ 50C/50% |
| | Antistat (PEDOT) | ROC Thickness (μm) | Antistat (PEDOT) | DRL Thickness (μm) | Antistat (PEDOT) | SL Thickness (μm) | | | | | | | | |
| C1 | no | n/a | 0.0% | 1.9 | 5% | 0.1 | 0.50 | 53.80 | 12.4 | no buckling/ no creasing | no | no bleed | no bleed | no bleed |
| C2 | no | n/a | 0.0% | 1.7 | 5% | 0.1 | 0.50 | 53.80 | 12.4 | no buckling/ no creasing | no | no bleed | bleed | bleed |
| C3 | no | n/a | 0.0% | 1.4 | 5% | 0.1 | 0.50 | 53.80 | 10.6 | no buckling/ no creasing | no | bleed | bleed | bleed |
| C4 | no | n/a | 0.0% | 1.4 | 5% | 0.1 | 0.50 | 53.80 | 9.26 | no buckling/ no creasing | no | no bleed | bleed | bleed |
| C5 | no | n/a | 0.0% | 1.4 | no | n/a | 0.00 | 0.00 | 13.6 | buckling & creasing | susceptible | no bleed | no bleed | no bleed |
| C6 | no | n/a | 0.75% | 1.4 | no | n/a | 1.05 | 8.07 | 12.9 | buckling & creasing | susceptible | no bleed | no bleed | no bleed |
| | | | | | | | | | | | | | | |
| E1 | no | n/a | 1.0% | 1.4 | no | n/a | 1.40 | 10.76 | 10.1 | no buckling/ no creasing | no | no bleed | no bleed | no bleed |
| E2 | no | n/a | 1.2% | 1.4 | no | n/a | 1.68 | 12.91 | 9.83 | no buckling/ no creasing | no | no bleed | no bleed | no bleed |

FIG. 3

| Dispersion ID# | 2-Layer DRL/ROC Approach | | | | | | | | | | | | |
|---|---|---|---|---|---|---|---|---|---|---|---|---|---|
| | ROC (receiver overcoat) | | DRL (dye-receiving layer) | | Sub-Layers | Total PEDOT mg/ft^2 | PEDOT conc. mg/cc | SER log Ω/square @70F/50%RH Face | Buckling/ Creasing at Max Donor Printing | White Dropouts or Spots | Image Bleed 1WK @ 35C/50% | Image Bleed 1WK @ 40C/50% | Image Bleed 1WK @ 50C/50% |
| | Antistat (PEDOT) | ROC Thickness (μm) | Antistat (PEDOT) | DRL Thickness (μm) | Antistat (PEDOT) | | | | | | | | |
| C8 | 1% | 0.2 | 0.0% | 1 | No | 0.20 | 10.76 | 13.3 | buckling & creasing | susceptible | no bleed | no bleed | no bleed |
| C9 | 1% | 0.3 | 0.0% | 1 | No | 0.30 | 10.76 | 13.1 | buckling & creasing | susceptible | no bleed | no bleed | no bleed |
| C10 | 1.2% | 0.1 | 0.0% | 1 | No | 0.12 | 12.91 | 13.5 | buckling & creasing | susceptible | no bleed | no bleed | no bleed |
| C11 | 1.2% | 0.15 | 0.0% | 1 | No | 0.18 | 12.91 | 13.3 | buckling & creasing | susceptible | no bleed | no bleed | no bleed |
| C12 | 1.2% | 0.2 | 0.0% | 1 | No | 0.24 | 12.91 | 13.3 | buckling & creasing | susceptible | no bleed | no bleed | no bleed |
| C13 | 1.2% | 0.2 | 0.0% | 1 | No | 0.24 | 12.91 | 13.3 | buckling & creasing | susceptible | no bleed | no bleed | no bleed |
| | | | | | | | | | | | | | |
| E3 | 1.5% | 0.38 | 0.0% | 0.71 | No | 0.57 | 16.14 | 8.9 | no buckling/ no creasing | no | no bleed | no bleed | no bleed |
| E4 | 1.5% | 0.48 | 0.0% | 0.71 | No | 0.71 | 16.14 | 8.8 | no buckling/ no creasing | no | no bleed | no bleed | no bleed |
| E5 | 1.5% | 0.62 | 0.0% | 0.71 | No | 0.92 | 16.14 | 8.7 | no buckling/ no creasing | no | no bleed | no bleed | no bleed |
| E6 | 1.6% | 0.3 | 0.0% | 0.96 | No | 0.48 | 17.22 | 8.9 | no buckling/ no creasing | no | no bleed | no bleed | no bleed |
| E7 | 1.6% | 0.29 | 0.0% | 0.91 | No | 0.46 | 17.22 | 8.8 | no buckling/ no creasing | no | no bleed | no bleed | no bleed |
| E8 | 2% | 0.36 | 0.0% | 0.71 | No | 0.71 | 21.52 | 8.0 | no buckling/ no creasing | no | no bleed | no bleed | no bleed |
| E9 | 2.5% | 0.38 | 0.0% | 0.71 | No | 0.95 | 26.90 | 8.3 | no buckling/ no creasing | no | no bleed | no bleed | no bleed |

FIG. 4

| Sample ID# | Weight % of Additional Surfactant Added to ROC (beyond amount of surfactant used to manufacture acrylic polymer) | | Visual Registration Rankings and Observations of Registration Accuracy and Print Quality (judged from the last 50 prints of donor spool) | |
|---|---|---|---|---|
| | Type of Additional Surfactant | % | Numerical ranking 1 = Best 5 = Worst | Description |
| C1 | No additional surfactant added | 0 | 3 | Not satisfied, not robust |
| C2 | No additional surfactant added | 0 | 4 | Poor misregistration |
| C3 | No additional surfactant added | 0 | 3 | Not satisfied, not robust |
| C4 | No additional surfactant added | 0 | 4 | Poor misregistration |
| C5 | No additional surfactant added | 0 | 4 | Poor misregistration |
| C6 | No additional surfactant added | 0 | 3 | Not satisfied, not robust |
| C7 | No additional surfactant added | 0 | 4 | Poor misregistration |
| C8 | No additional surfactant added | 0 | 4 | Poor misregistration |
| C9 | No additional surfactant added | 0 | 4 | Poor misregistration |
| E1 | Rhodacal A-246 | 2.5 | 1 | Good---no to minimum misregistration |
| E2 | Olin 10G | 2.5 | 1 | Good---no to minimum misregistration |
| E3 | Rhodapex CO-436 | 2.5 | 2 | Marginally acceptable |
| E4 | Dowfax 2A1 | 2.5 | 1 | Good---no to minimum misregistration |
| E5 | SDBS | 2.5 | 1 | Good---no to minimum misregistration |
| E6 | SDS | 2.5 | 2 | Acceptable |
| E7 | Silwet L-7230 | 2.5 | 1 | Good---no to minimum misregistration |

FIG. 5

| Sample ID# | Acrylic Polymer Latex Composition (Note: surfactant was added during the making of latex) | | Visual Registration Rankings and Observations of Registration Accuracy (judged from the last 50 prints of donor spool) | |
|---|---|---|---|---|
| | Weight Ratio of Monomers in Acrylic Polymer: Group (c) / Group (a) / Group (b) | Weight % of Surfactant (Rhodacal A246) Added in Making Acrylic Polymer | Numerical Ranking 1 = Best 5 = Worst | Observations of Registration Accuracy |
| C10 | 48/50/2 | 0.5 | 4 | Poor misregistration |
| C11 | 58/40/2 | 0.5 | 4 | Poor misregistration |
| C12 | 53/45/2 | 1 | 4 | Poor misregistration |
| E8 | 48/50/2 | 2 | 2 | Marginally acceptable |
| E9 | 58/40/2 | 2 | 2 | Marginally acceptable |
| E10 | 53/45/2 | 4 | 1 | Good—no to minimum misregistration |

FIG. 6

| Dispersion ID# | Dye Receiving Layer Composition | | | Foam Height Above Initial Liquid Level (cm) | | |
|---|---|---|---|---|---|---|
| | Surfactant – Type and Amount | Surfactant – Type and Amount | Antifoamer – Type and Amount | 0 minutes after 2 min mix @ 2000rpm | After 1 min wait | After 2 min wait |
| E1 | Olin 10G (4%) | FS-30 (0.04%) | Siltech C-4830 at 0.08% | 3.5 | 1.8 | 0.5 |
| E2 | Olin 10G (4%) | - | Siltech C-4830 at 0.32% | 0.5 | 0.0 | 0.0 |
| E3 | Olin 10G (4%) | - | Tego Foamex 825 at 0.04% | 2.7 | 2.3 | 2.0 |
| E4 | Olin 10G (4%) | FS-30 (0.04%) | Tego Foamex 825 at 0.08% | 2.4 | 2.0 | 1.8 |
| E5 | Olin 10G (4%) | - | Tego Foamex 825 at 0.08% | 2.0 | 1.7 | 1.6 |
| E6 | Olin 10G (4%) | - | Tego Foamex 825 at 0.16% | 1.8 | 0.8 | 0.6 |
| E7 | Olin 10G (4%) | - | Tego Foamex 825 at 0.20% | 1.0 | 0.2 | 0.0 |
| E8 | Olin 10G (4%) | - | Tego Foamex 825 at 0.24% | 0.6 | 0.0 | 0.0 |
| E9 | Olin 10G (4%) | - | Tego Foamex 825 at 0.32% | 0.7 | 0.0 | 0.0 |
| C1 | - | - | - | 5.3 | 4.8 | 4.8 |
| C2 | Olin 10G (4%) | - | - | 5.3 | 4.8 | 4.8 |

FIG. 7

| | Antifoamers | | Antifoamer Diluent | Antifoamer Concentration in PPM | Foam Height Above Initial Liquid Level(cm) | | |
|---|---|---|---|---|---|---|---|
| Dispersion ID# | Supplier | Trade Names | | | 0 minutes after 2 min mix | After 1 min wait | After 2 min wait |
| C1 | - | - | Dilution | 0 | 5.1 | 5.1 | 5 |
| F1 | Air Products | Dynol 607 | water | 100 | 5.1 | 5.1 | 4.9 |
| F2 | Air Products | Dynol 607 | water | 400 | 5.3 | 5.2 | 5.0 |
| F3 | EvoniK | Tego Foamex 800 | water | 100 | 5.2 | 4.9 | 4.6 |
| F4 | EvoniK | Tego Foamex 800 | water | 400 | 4.4 | 4.3 | 3.8 |
| F5 | EvoniK | Tego Foamex 805 | water | 100 | 5.2 | 5.1 | 4.9 |
| F6 | EvoniK | Tego Foamex 805 | water | 400 | 5.2 | 5.1 | 4.8 |
| F7 | Momentive | Silwet L-7200 | water | 100 | 5.1 | 5.0 | 4.8 |
| F8 | Momentive | Silwet L-7200 | water | 400 | 5.0 | 5.0 | 4.8 |
| F9 | Momentive | Silwet L-7210 | water | 100 | 4.9 | 4.8 | 4.5 |
| F10 | Momentive | Silwet L-7210 | water | 800 | 4.3 | 4.0 | 3.7 |
| F11 | Momentive | Silwet L-7210 | water | 1200 | 4.6 | 4.4 | 4.0 |
| F12 | Momentive | Silwet L-7607 | water | 100 | 5.0 | 5.0 | 4.8 |
| F13 | Momentive | Silwet L-7607 | water | 400 | 5.1 | 5.0 | 4.8 |
| F14 | Dow Corning | Dow Corning 6 Additive | water | 100 | 4.9 | 4.8 | 4.5 |
| F15 | Dow Corning | Dow Corning 6 Additive | water | 400 | 4.7 | 4.5 | 3.5 |
| F16 | Dow Corning | Xiameter AFE-1430 | water | 100 | 5.0 | 4.8 | 4.5 |
| F17 | Dow Corning | Xiameter AFE-1430 | water | 400 | 4.8 | 4.6 | 4.0 |
| | | | | | | | |
| E10 | Siltech | Siltech C-4830 | water | 400 | 2.0 | 1.4 | 1.0 |
| E11 | Siltech | Siltech C-4830 | water | 800 | 1.0 | 0.7 | 0.4 |
| E12 | Siltech | Siltech C-4830 | water | 1200 | 0.5 | 0.4 | 0.4 |
| E13 | Air Products | Airase 5300 | IBA | 400 | 2.2 | 2.0 | 1.8 |
| E14 | Air Products | Airase 5300 | IBA | 800 | 1.5 | 1.3 | 1.2 |
| E15 | Air Products | Airase 5300 | IBA | 1200 | 0.3 | 0.2 | 0.2 |
| E16 | Air Products | Airase 5500 | IBA | 400 | 1.4 | 1.3 | 1.2 |
| E17 | Air Products | Airase 5500 | IBA | 800 | 0.6 | 0.4 | 0.4 |
| E18 | Air Products | Airase 5500 | IBA | 1200 | 0.4 | 0.2 | 0.2 |
| E19 | Air Products | Airase 5700 | IBA | 400 | 1.9 | 1.8 | 1.7 |
| E20 | Air Products | Airase 5700 | IBA | 800 | 0.9 | 0.9 | 0.8 |
| E21 | Air Products | Airase 5700 | IBA | 1200 | 0.5 | 0.3 | 0.2 |
| E22 | EvoniK | Tego Foamex 825 | water | 200 | 2.7 | 1.5 | 1.1 |
| E23 | EvoniK | Tego Foamex 825 | water | 400 | 1.8 | 0.8 | 0.5 |
| E24 | EvoniK | Tego Foamex 825 | water | 800 | 1.0 | 0.4 | 0.4 |
| E25 | EvoniK | Tego Foamex 825 | water | 1200 | 0.6 | 0.4 | 0.4 |
| E26 | Momentive | Silwet L-7220 | water | 400 | 3.5 | 3.2 | 2.9 |
| E27 | Momentive | Silwet L-7220 | water | 800 | 2.6 | 2.3 | 2.1 |
| E28 | Dow Corning | Dow Corning 62 Additive | water | 400 | 2.6 | 2.2 | 2.0 |
| E29 | Dow Corning | Dow Corning 62 Additive | water | 800 | 2.6 | 2.1 | 1.6 |
| E30 | Dow Corning | Dow Corning 62 Additive | water | 1200 | 2.9 | 1.7 | 1.3 |

FIG. 8

ROC Filterability Results

| Dispersion ID# | 1 | 2 | 3 | 4 | 5 | 6 | 7 | 8 | 9 | 10 | FQT/WTP gm | Filterability Ranking |
|---|---|---|---|---|---|---|---|---|---|---|---|---|
| C1 | H2O | L-3%E | XL-1 | P | S | V | IBA | DEG | - | - | 3.6 | not acceptable to marginally acceptable |
| E1 | H2O | L-3%E | XL-1 | P | S | V | IBA | DEG | Olin 10G @ 4% | - | 8.6 | marginally acceptable to acceptable |
| E2 | H2O | L-3%E | XL-1 | P | S | V | IBA | DEG | BE-23 @ 4% | - | 59.9 | acceptable to very good |
| E3 | H2O | L-3%E | XL-1 | P | S | V | IBA | DEG | Olin 10G @ 3% | - | 8.2 | marginally acceptable to acceptable |
| E4 | H2O | L-3%E | XL-1 | P | S | V | IBA | DEG | BE-23 @ 3% | - | 77.8 | very good to excellent |
| E5 | H2O | L-3%E | XL-1 | P | S | V | IBA | DEG | BOE @ 3% | - | 45.9 | acceptable to very good |
| E6 | H2O | L-3%E | XL-1 | P | S | V | IBA | DEG | Efka PX 4701 @ 3% | - | 8.8 | marginally acceptable to acceptable |
| E7 | H2O | L-3%E | XL-1 | P | S | V | IBA | DEG | E-Sperse 100 @ 3% | - | 8.5 | marginally acceptable to acceptable |
| E8 | H2O | L-3%E | XL-1 | P | S | V | IBA | DEG | E-Sperse 700 @ 3% | - | 7.8 | marginally acceptable to acceptable |
| E9 | H2O | L-3%E | XL-1 | P | S | V | IBA | DEG | BE-23 @ 2% | Olin 10G @ 1% | 62.3 | acceptable to very good |
| E10 | H2O | L-3%E | XL-1 | P | S | V | IBA | DEG | BE-23 @ 2% | Efka PX 4701 @ 1% | 61.0 | acceptable to very good |
| E11 | H2O | L-3%E | XL-1 | P | S | V | IBA | DEG | BE-23 @ 1% | Efka PX 4701 @ 2% | 31.4 | acceptable to very good |
| E12 | H2O | L-3%E | XL-1 | P | S | V | IBA | DEG | BE-23 @ 2% | E-Sperse 100 @ 1% | 59.9 | acceptable to very good |
| E13 | H2O | L-3%E | XL-1 | P | S | V | IBA | DEG | BE-23 @ 2% | E-Sperse 700 @ 1% | 53.6 | acceptable to very good |
| E14 | H2O | L-3%E | XL-1 | P | S | V | IBA | DEG | Efka PX 4701 @ 2% | Olin 10G @ 1% | 10.7 | marginally acceptable to acceptable |
| E15 | H2O | L-3%E | XL-1 | P | S | V | IBA | DEG | E-Sperse 100 @ 2% | Olin 10G @ 1% | 7.5 | marginally acceptable to acceptable |
| E16 | H2O | L-3%E | XL-1 | P | S | V | IBA | DEG | E-Sperse 700 @ 2% | Olin 10G @ 1% | 7.7 | marginally acceptable to acceptable |

CONDUCTIVE THERMAL IMAGING RECEIVING LAYER WITH RECEIVER OVERCOAT LAYER

CROSS-REFERENCE TO RELATED APPLICATION

This application is a continuation-in-part of U.S. application Ser. No. 14/599,607, filed on Jan. 19, 2015, which is a continuation-in-part of U.S. application Ser. No. 14/560,937, filed on Dec. 4, 2014, which claims priority to U.S. Provisional Application Nos. 61/977,361 and 61/913,262, filed on Apr. 9, 2014, and Dec. 7, 2013, respectively. This application also claims the benefit of U.S. Provisional Application No. 62/155,906, filed on May 1, 2015.

BACKGROUND OF THE INVENTION

This invention relates to a conductive thermal image receiver element for use in thermal printing. In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then transmitted to a thermal printer. To obtain the print, a cyan, magenta or yellow dye donor element is placed face-to-face with a thermal image receiver element. The two are then inserted between a thermal printing head and a platen roller. A line-type thermal printing head is used to apply heat from the back of the dye-donor sheet. The thermal printing head has many heating elements and is heated sequentially in response to one of the cyan, magenta or yellow signals. The process is then repeated for the other colors. A color hard copy is thus obtained which corresponds to the original picture viewed on a screen.

Various approaches have been suggested for providing a thermal dye-receiving layer. Solvent coating of the dye image receiving layer formulation is a common approach. However, the use of solvents to coat these formulations brings with it various problems including expense, environmental hazards and waste concerns, and hazardous manufacturing processes. Special precautions are required to manage these problems. Another approach involves hot-melt extrusion of the dye image receiving layer formulation onto a support. Multiple layers can be co-extruded in the preparation of the thermal image receiver element. Such methods are highly effective to prepare useful thermal image receiver elements, but they restrict the type of materials that can be incorporated into the dye image receiving layer due to the high temperatures used for the extrusion process. Yet another approach is to use aqueous coating formulations to prepare the dye image receiving layers. Such formulations typically include a water-soluble or water-dispersible polymer as the binder matrix.

Although aqueous coating methods and formulations are desired for the noted reasons, aqueous-coated dye image receiving layers can exhibit problems in typical customer printing environments where high speed printing requires a smooth separation of dye donor element and the thermal image receiver element with no sticking between the contacting surfaces of the two elements. Printing such images in high humidity environments can be particularly troublesome for sticking with aqueous-coated dye image receiver layers. Moreover, such thermal image receiver elements are often deficient in providing adequate dye density in the thermally formed images. Aqueous-coated layers can also fall apart when contacted with water. The industry has aggressively approached these problems with various proposed solutions that are described in the literature.

Despite all of the known approaches to the various problems associated with the use of aqueous coated dye image receiving layer formulations, there continues to be a need to improve the resistance of such formulations (and the dried layers obtained therefrom) to changes in relative humidity so that the resulting images are consistent and exhibit sufficient density, no matter the relative humidity in which the thermal dye transfer elements are stored or used.

SUMMARY OF THE INVENTION

This invention relates to a conductive thermal image receiver element that has an aqueous-based coatable dye-receiving layer comprising a release agent, a cross linking agent, a water-dispersible acrylic polymer, a water-dispersible polyester and a water-dispersible conductive polymeric material. The invention further relates to a conductive thermal image receiver element that has an aqueous-based coatable dye-receiving layer comprising a release agent, a cross linking agent, water-dispersible acrylic polymer, a water-dispersible polyester and a receiver overcoat layer comprising a water-dispersible conductive polymeric material. In addition, a surfactant may be added to the receiver overcoat layer, or excess surfactant can be added in the manufacture of the water-dispersible acrylic polymer. This invention also relates to a method for making this thermal image receiver element as well as method for using it to provide a dye image by thermal transfer from a donor element.

For example, the conductive thermal image receiver element may comprise a support, and having on at least one side of the support: an electrically conductive layer comprising an outermost layer wherein the outermost layer is an aqueous coatable dye-receiving layer having a thickness ranging from 0.1 μm to 5 μm, and wherein the aqueous dye-receiving layer comprises a water-dispersible release agent, a cross-linking agent, and polymer binder matrix consisting essentially of: (1) a water-dispersible acrylic polymer comprising chemically reacted or chemically non-reacted hydroxyl, phospho, phosphonate, sulfo, sulfonate, carboxy, or carboxylate groups; (2) a water-dispersible polyester that has a $T_g$ of 30° C. or less, wherein the water-dispersible acrylic polymer is present in an amount of at least 55 weight % of the total aqueous coatable dye-receiving layer weight and is present at a dry ratio to the water-dispersible polyester of at least 1:1; and (3) a water-dispersible conductive polymeric material.

The water-dispersible conductive polymeric material can be present in the aqueous dye-receiving layer at an amount ranging from 0.75% to 2.0% by weight, or an amount ranging from 1.0% to 1.25% by weight, or an amount ranging from 0.75% to 1.5% by weight.

The conductive thermal image receiver element may have, in addition, any one or more of the following features. The water-dispersible acrylic polymer may comprise chemically reacted or chemically non-reacted carboxy or carboxylate groups and may be crosslinked through hydroxyl or carboxy groups to provide aminoester, urethane, amide, or urea groups. The water-dispersible acrylic polymer may also comprise recurring units derived from: (a) one or more ethylenically unsaturated polymerizable acrylates or methacrylates comprising acyclic alkyl ester, cycloalkyl ester, or aryl ester groups having at least 4 carbon atoms, (b) one or more carboxy-containing or sulfo-containing ethylenically unsaturated polymerizable acrylates or methacrylates, and (c) optionally styrene or a styrene derivative, wherein the (a) recurring units represent at least 20 mol % and up to and including 99 mol % of the total recurring units, and the (b) recurring units represent at least 1 mol % and up to and including 10 mol %. Typically, the water-dispersible acrylic polymer is present in an amount of at least 55 weight % and up to and including 90 weight % of the total aqueous coatable dye-receiving layer weight. Alternatively, the water-dispersible acrylic polymer may be present in an amount of at least 60 weight % and up to and including 90 weight % of the total dry image receiving layer weight. The weight ratio of the water-dispersible acrylic polymer to the water-dispersible polyester in the polymer binder matrix is from 1:1 to and including 20:1, or more specifically, from 4:1 up to and including 15:1.

The water-dispersible polyester has a $T_g$ of at least −10° C. and up to and including 30° C. and the dye image receiving layer itself has a $T_g$ of at least 35° C. and up to and including 70° C. The outermost layer of the thermal image receiver element has a dry thickness ranging from 0.8 μm to 2.0 μm, or from 1.2 to 1.4 μm, or from 0.1 μm to 5 μm.

Generally, the support is a polymeric film or a resin-coated cellulosic paper base, a microvoided polymeric film or wherein the support comprises a cellulosic paper base or a synthetic paper base. The conductive thermal image receiver element of the present invention may be a single-sided or duplex thermal image receiver. A duplex thermal image receiver element typically comprises the same or different aqueous coatable dye-receiving layer on both opposing sides of the support. The aqueous coatable dye-receiving layer may be disposed directly on one or both opposing sides of the support. Or, alternatively, the conductive thermal image receiver element of the present invention may comprise one or more intermediate layers between the support and the aqueous coatable dye-receiving layer on one or both opposing sides of the support.

Referring now to the water-dispersible release agent that is included in the aqueous dye-receiving layer, useful release agents are selected from the group consisting of a water-dispersible fluorine-based surfactant, a silicone-based surfactant, a modified silicone oil, a polysiloxane, a modified polysiloxane and a cross-linked amino modified polydimethyl siloxane. More specifically, the water-dispersible release agent may be a polysilicone that is modified with amino side chains or terminal groups, and is present in an amount of at least 1 weight to 3 weight %, based on the total dry image receiving layer weight. Alternatively, the water-dispersible release agent may be a water-dispersible polyoxyalkylene-modified dimethylsiloxane graft copolymer having at least one alkylene oxide pendant chain having more than 45 alkoxide units. Typically, the water-dispersible release agent is present in an amount of at least 1.0% to and including 5% by weight, based on the total dry image receiving layer weight.

Referring now to the crosslinking agent that is included in the aqueous dye-receiving layer, such crosslinking agent may be a carbodiimide or an aziridine derivative compound. Generally, the crosslinking agent is an individual compound or mixture of compounds chosen from the group consisting of melamine formaldehyde resins, glycoluril formaldehyde resins, plycarboxylic acids and anhydrides, polyamines, epihalohydrins, diepoxides, dialdehydes, diols, carboxylic acid halides, ketenes, aziridines, carbodiimides, and isocyanates.

In another aspect of the present invention, the conductive thermal image receiver element may comprise a support, and having one or both opposing sides of the support: a dry image receiving layer having a $T_g$ of at least 35° C. and up to and including 60° C., which dry image receiving layer is the outermost layer of the thermal image receiver element, has a dry thickness of at least 1 μm and up to and including 3 μm, and comprises a water dispersible release agent, a cross-linking agent, a water-dispersible conductive polymeric material, and a polymer binder matrix that consists essentially of: (1) a water-dispersible acrylic polymer comprising chemically reacted or chemically non-reacted carboxy or carboxylate groups, wherein the water-dispersible acrylic polymer comprises recurring units derived from: (a) one or more ethylenically unsaturated polymerizable acrylates or methacrylates comprising acrylic alkyl ester, cycloalkyl ester, or aryl ester groups having at least 4 carbon atoms, (b) one or more carboxy-containing or carboxylate salt-containing ethylenically unsaturated polymerizable acrylates or methacrylates, and (c) optionally styrene or a styrene derivative, wherein the (a) recurring units represent at least 20 mol % and up to and including 99 mol % of the total recurring units, and the (b) recurring units represent at least 1 mol % and up to and including 10 mol %, and (2) a water-dispersible, film-forming polyester that has a $T_g$ of at least 0° C. and up to and including 20° C., which water-dispersible, film-forming polyester having water-dispersibility groups, wherein the water-dispersible acrylic polymer is present in an amount of at least 60 weight % and up to and including 90 weight % of the total dry image receiving layer weight, and is present in the polymer binder matrix at a dry ratio to the water-dispersible polyester of at least 4:1 and up to and including 20:1.

Another variation of the present invention provides a thermal image receiver element comprising a support, and having on at least one side of the support: a dry image receiving layer as the outermost layer of the thermal image receiver element, the dry image receiving layer having a $T_g$ of at least 25° C. and up to and including 70° C., a dry thickness of at least 0.5 μm and up to and including 5 μm, the dry image receiving layer comprising a water-dispersible release agent, a crosslinking agent, a water-dispersible conductive polymeric material, and a polymer binder matrix consisting essentially of: (1) one or more water-dispersible acrylic polymers derived from one or more ethylenically unsaturated polymerizable monomers; and (2) a water-dispersible polyester that has a $T_g$ of 30° C. or less, wherein the one or more water-dispersible acrylic polymers are present in an amount of at least 55 weight % and up to and including 90 weight % based on the total dry image receiving layer weight; the one or more water-dispersible acrylic polymers are present in the polymer binder matrix at a dry ratio to the water-dispersible polyester of at least 1:1 up to and including 20:1; and the water-dispersible release agent is present in an amount of at least 0.5 weight % and up to and including 10 weight % based on the total weight of the dry image receiving layer.

Also disclosed is an imaging assembly comprising a thermal image receiver element according to any of the specifications described herein, wherein the thermal image receiver element is placed in thermal association with a thermal donor element.

Another aspect of the present invention is a method for making the conductive thermal image receiver element described herein. The method comprises the following steps: (A) applying an aqueous image receiving layer formulation to one or both opposing sides of a support, the aqueous image receiving layer formulation comprising a water-dispersible release agent, a cross-linking agent, a water dispersible conductive polymeric material, and a polymer binder composition consisting essentially of: (1) a water-dispersible acrylic polymer comprising chemically reacted or chemically non-reacted hydroxyl, phospho, phosphonate, sulfo, sulfonate, carboxy, or carboxylate groups, and (2) a water-dispersible polyester that has a $T_g$ of 30° C. or less, wherein the water-dispersible acrylic polymer is present in an amount of at least 55 weight % of the resulting total dry image receiving layer weight, and is present in the polymeric binder matrix at a dry ratio to the water-dispersible polyester of at least 1:1 to and including 20:1; and (B) drying the aqueous image receiving layer formulation to form a dry image receiving layer on one or both opposing sides of the support. According to that method, the aqueous image receiving layer formulation may additionally be heat treated at a temperature of at least 70° C. The method may further comprise the steps of applying the aqueous image receiving layer formulation to the support and drying it to provide the dry image receiving layer in a predetermined pattern.

A related method of printing comprises: imagewise transferring a clear polymeric film, one or more dye images, or both a clear polymeric film and one or more dye images, from a thermal donor element to the image receiving layer of the any of the dry conductive thermal image receiving element described herein.

In an variation of the present invention, the conductive thermal receiving element may comprise a support, and having on at least one side of the support: an electrically conductive layer comprising an outermost layer wherein the outermost layer is an aqueous coatable dye-receiving layer having a thickness ranging from 1.0 μm to 1.2 μm and wherein the aqueous dye-receiving layer comprises a water dispersible release agent, a cross-linking agent, and polymer binder matrix consisting essentially of: (1) a water-dispersible acrylic polymer comprising chemically reacted or chemically non-reacted hydroxyl, phospho, phosphonate, sulfo, sulfonate, carboxy, or carboxylate groups; (2) a water-dispersible polyester that has a $T_g$ of 30° C. or less; wherein the water-dispersible acrylic polymer is present in an amount of at least 55 weight % of the total aqueous coatable dye-receiving layer weight and is present at a dry ratio to the water-dispersible polyester of at least 1:1; and (3) a receiver overcoat layer comprising a water-dispersible conductive polymeric material.

The thickness of the receiver overcoat layer ranges from 0.1 μm to 0.62 μm, from 0.10 μm to 0.8 μm, or from 0.29 μm to 0.62 μm. Moreover, the water-dispersible conductive polymeric material may be present in the receiver overcoat layer in an amount of greater than or equal to 1.0% by weight, or in the range of 1.0% to 3.0% by weight, or 1.2% to 3.0% by weight of the total dry weight of the receiver overcoat layer. In other terms, the water-dispersible conductive polymeric material may be present in the receiver overcoat layer at greater than 10.76 mg/cm$^3$.

Another aspect of the present invention is a method for making the conductive thermal image receiver element described herein. The method may comprise the following steps: (A) applying an aqueous coatable dye-receiving layer formulation to one or both opposing sides of a support, the aqueous coatable dye-receiving layer formulation comprising a water-dispersible release agent, a cross-linking agent, and a polymer binder composition consisting essentially of: (1) a water-dispersible acrylic polymer comprising chemically reacted or chemically non-reacted hydroxyl, phospho, phosphonate, sulfo, sulfonate, carboxy, or carboxylate groups, and (2) a water-dispersible polyester that has a $T_g$ of 30° C. or less; wherein the water-dispersible acrylic polymer is present in an amount of at least 55 weight % of the resulting total dry image receiving layer weight, and is present in the polymeric binder matrix at a dry ratio to the water-dispersible polyester of at least 1:1 to and including 9.2:1, or at least 4:1 to and including 20:1; (C) drying the aqueous image receiving layer formulation to form a dry image receiving layer on one or both opposing sides of the support; (D) applying a receiver overcoat layer comprising a conductive polymeric material to at least on one side of a support coated with an aqueous coatable dye-receiving layer, (E) drying the aqueous image receiving layer formulation to form a dry image receiving layer on one or both opposing sides of the support.

According to such method, the aqueous coatable dye-receiving layer formulation is heat treated at a temperature of at least 70° C. Further, the aqueous coatable dye-receiving layer formulation is applied to the support and dried to provide the dry image receiving layer in a predetermined pattern. The same aqueous coatable dye-receiving layer formulation may be applied to both opposing sides of the support.

A feature of the present invention is the inclusion of conductive polymeric material in the outermost layer of a thermal image receiver element. The invention provides that the water-dispersible conductive polymeric material comprises Poly(3,4-ethylendioxythiophene)-poly(styrenesulfonate). Alternatively, the water-dispersible conductive polymeric material may consist essentially of Poly(3,4-ethylendioxythiophene)-poly(styrenesulfonate) and a polar solvent.

Another feature of the present invention is the inclusion of additional surfactant and/or dispersants in a receiver overcoat layer. Namely, the present invention provides a conductive thermal image receiver element comprising an aqueous coatable dye-receiving layer, as well as a receiver overcoat layer, wherein the receiver overcoat layer comprises a water-dispersible conductive polymeric material and a surfactant. Typically, the surfactant is present in the receiver overcoat layer at about 2.5 weight %, or in an amount ranging from 1 to 5 weight %. In addition to, or in place of, the surfactant, one or more dispersants may also be included in the receiver overcoat. Useful dispersants are: a random copolymer comprising benzyl methacrylate and methacrylic acid, a random terpolymer of benzyl methacrylate, octadecyl methacrylate, and methacrylic acid, and an acrylic block copolymer or terpolymer. In certain variations of the present invention, a surfactant is present in the receiver overcoat at about 1 to 4% by weight, or more specifically about 2%. One or more dispersants may also be present in the receiver overcoat, with or without the surfactant. The one or more dispersants are present in the receiver overcoat at about 0.5 to 6% by weight (in total for all dispersants included in the receiver overcoat), or more specifically about 1% to 3% by weight, based on the total dry weight of the receiver overcoat layer.

According to the present invention the conductive thermal image receiver element may alternatively comprise a support, and having on at least one side of the support: an electrically conductive layer comprising an outermost layer wherein the outermost layer is an aqueous coatable dye-receiving layer having a thickness ranging from 0.1 μm to 5 μm, and wherein the aqueous dye-receiving layer comprises a water-dispersible release agent, a cross-linking agent, and polymer binder matrix consisting essentially of: (1) a water-dispersible acrylic polymer comprising chemically reacted or chemically non-reacted hydroxyl, phospho, phosphonate, sulfo, sulfonate, carboxy, or carboxylate groups, wherein the water-dispersible acrylic polymer comprises excess surfactant in excess of 1% used to prepare the acrylic polymer; (2) a water-dispersible polyester that has a $T_g$ of 30° C. or less, wherein the water-dispersible acrylic polymer is present in an amount of at least 55 weight % of the total aqueous coatable dye-receiving layer weight and is present at a dry ratio to the water-dispersible polyester of at least 1:1; and (3) a water-dispersible conductive polymeric material.

In a variation, the conductive thermal image receiver element may comprise a support, and having on at least one side of the support: an electrically conductive layer comprising an outermost layer wherein the outermost layer is an aqueous coatable dye-receiving layer having a thickness ranging from 0.1 μm to 5 μm, and wherein the aqueous dye-receiving layer comprises a water-dispersible release agent, a cross-linking agent, and polymer binder matrix consisting essentially of: (1) a water-dispersible acrylic polymer comprising chemically reacted or chemically non-reacted hydroxyl, phospho, phosphonate, sulfo, sulfonate, carboxy, or carboxylate groups, wherein the water-dispersible acrylic polymer comprises excess surfactant in excess of 1% used to prepare the acrylic polymer; (2) a water-dispersible polyester that has a $T_g$ of 30° C. or less; wherein the water-dispersible acrylic polymer is present in an amount of at least 55 weight % of the total aqueous coatable dye-receiving layer weight and is present at a dry ratio to the water-dispersible polyester of at least 1:1; and (3) a receiver overcoat layer comprising a water-dispersible conductive polymeric material. The excess surfactant may be present in an amount of about 1% to 5% by weight.

A further feature of the present invention is the inclusion of one or more antifoamers in the dye-receiving layer of a thermal image receiver element. For example, an embodiment provides a conductive thermal image receiver element with a dye-receiving layer, as described throughout this disclosure, wherein the dye-receiving layer comprises a surfactant and an antifoamer. The antifoamer may be selected from the group consisting of: DYNOL 607 by Air Products®, TEGO FOAMEX 800 by Evonik®, TEGO FOAMEX 805 by Evonik®, TEGO FOAMEX 825 by Evonik®, SILWET L-7200 by Momentive®, SILWET L-7210 by Momentive®, SILWET L-7220 by Momentive®, SILWET L-7607 by Momentive®, Dow Corning® 6 Additive, Dow Corning® 62 Additive, XIAMETER AFE-1430 by Dow Corning®, SILTECH C-4830, by Siltech, AIRASE 5300 by Air Products®, AIRASE 5500 by Air Products®, and AIRASE 5700 by Air Products®. Generally, the antifoamer is present in an amount of 0.01 to 0.32% by weight based on the total dry weight of the dye-receiving layer.

In other terms, the dye-receiving layer comprising an antifoamer is derived from an aqueous polymer emulsion. Such aqueous polymer emulsion yields a foam height of less than or equal to 3.5 cm above an initial liquid level after mixing the aqueous polymer emulsion at 2000 rpm for two minutes. More specifically, the aqueous polymer emulsion yields a foam height of 0 cm above the initial liquid level after mixing the aqueous polymer emulsion at 2000 rpm for two minutes and waiting an additional minute.

The invention will be described in greater detail with particular reference to certain embodiments thereof, but it will be understood that variations and modifications can be effected within the spirit and scope of the invention.

BRIEF DESCRIPTION OF THE FIGURES

FIG. 1A illustrates an embodiment where the aqueous coatable dye-receiving layer ("DRL") (layer (1)) with conductive polymeric material is the outermost (or top) layer. FIG. 1B illustrates an embodiment where the aqueous receiver overcoat layer ("ROC") (layer (1*a*)) is the outermost (or top) layer and lies on top of the aqueous coatable DRL (layer (1*b*)).

FIG. 2 provides study results of a thermal image receiver element comprising a single-layer aqueous coatable dye-receiving layer (akin to the one shown in FIG. 1A), wherein the DRL comprises a polymer binder matrix consisting essentially of a water dispersible acrylic polymer, a water dispersible polyester and a water dispersible conductive polymeric material.

FIG. 3 provides study results of a thermal image receiver element comprising a two-layer aqueous coatable dye-receiving layer (akin to the one shown in FIG. 1B), wherein the two-layer DRL comprises a polymer binder matrix consisting essentially of a water dispersible acrylic polymer, a water dispersible polyester, and a receiver overcoat later comprising a water dispersible conductive polymeric material.

FIG. 4 provides a table showing the results of various experiments where a surfactant was added to the receiver overcoat layer of a two-layer DRL. When no surfactant was added, there were an undesirable amount of misregistrations. However, when additional surfactant was added at about 2.5% by weight, the number of misregistrations dropped to none, or an acceptable minimum number.

FIG. 5 provides a table showing the results of various experiments where surfactant was added in excess over the 1% normally used to manufacture the acrylic polymer. When no excess surfactant was added, undesirable misregistration occurred. However, when the surfactant was added at about 2% by weight (or 1% excess) or greater, misregistration errors were reduced to an acceptable level.

FIG. 6 provides a table showing the results of employing an antifoamer in various dispersions of aqueous DRL formulations. As can be seen, the addition of an antifoamer in the aqueous dispersion can significantly reduce the foam height.

FIG. 7 provides a table showing various antifoamers that were tested in dispersions of aqueous DRL formulations and the affect such antifoamers had on the actual foam height above the aqueous system after mixing.

FIG. 8 provides a table detailing filterability testing results for various dispersions of aqueous ROC formulations.

DETAILED DESCRIPTION OF THE INVENTION

Figure 1A:
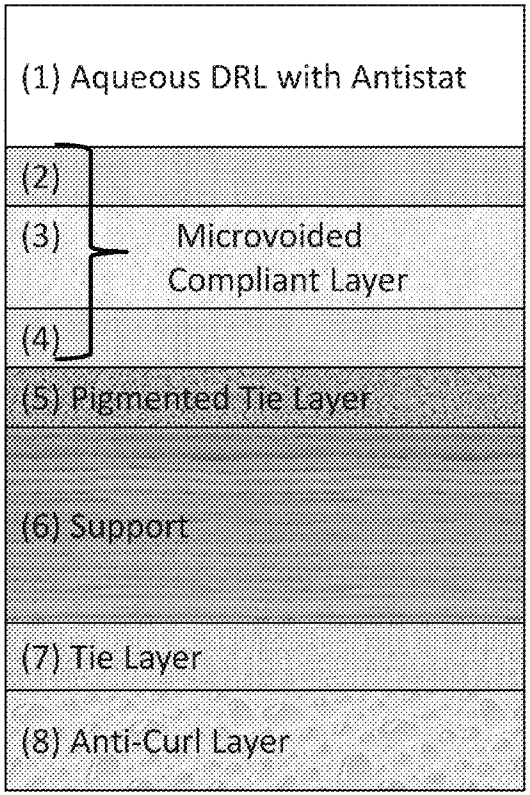
FIGS. 1A and 1B provide schematic overviews of two different thermal image receiving elements.

As used herein to define various components of the compositions, formulations, and layers described herein, unless otherwise indicated, the singular forms "a," "an," and "the" are intended to include one or more of the components (that is, including plurality referents).

The use of numerical values in the various ranges specified herein, unless otherwise expressly indicated otherwise, are considered to be approximations as though the minimum and maximum values within the stated ranges were both preceded by the word "about." In this manner, slight variations above and below the stated ranges can be used to achieve substantially the same results as the values within the ranges. In addition, the disclosure of these ranges is intended as a continuous range including every value between the minimum and maximum values.

Unless otherwise indicated, the terms "thermal image receiver element" and "receiver element" are used interchangeably to refer to features of the present invention.

The term "duplex" is used to refer to embodiments of the present invention in which each of the opposing sides of the substrate (defined below) has a dry image receiving layer (defined below), and therefore each side is capable of forming a thermal image (clear polymeric film or dye image), although it is not required in the method of this invention that a thermal image always be formed on both sides of the substrate. A "duplex" element can also be known as a "dual-sided" element.

Glass transition temperatures ($T_g$) can be determined using Differential Scanning calorimetry (DSC) and known procedures, for example wherein differential power input is monitored for the sample composition and a reference as they are both heated at a constant rate and maintained at the same temperature. The differential power input can be plotted as a function of the temperature and the temperature at which the plot undergoes a sharp slope change is generally assigned as the $T_g$ of the sample polymer or dry image receiving layer composition.

Unless otherwise indicated, % solids or weight % are stated in reference to the total dry weight of a specific composition or specific composition of a specific layer.

The term "thermal donor element" is used to refer to an element (defined below) that can be used to thermally transfer a dye, ink, clear film, or metal. It is not necessary that each thermal donor element transfer only a dye or ink.

The term "thermal association" is used to refer to two different elements that are disposed in a relationship that allows thermal transfer of a dye, metal, or thin polymer film. Such a relationship generally requires intimate physical contact of the two elements while they are being heated.

The term "aqueous-coated" is used to refer to a layer that is applied or coated out of an aqueous coating formulation.

The term "aqueous coatable" is used to refer to a layer that is applied or coated as an aqueous coating formulation but then can dry to become a dry layer.

Unless otherwise indicated, the terms "polymer" and "resin" mean the same thing Unless otherwise indicated, the term "acrylic polymer" is meant in encompass both homopolymers having the same recurring unit along the organic backbone, as well as copolymers having two or more different recurring units along the backbone.

The term "ethylenically unsaturated polymerizable monomer" refers to an organic compound that has one or more ethylenically unsaturated polymerizable groups (such as vinyl groups) that can be polymerized to provide an organic backbone chain of carbon atoms, and optionally various side chains attached to the organic backbone. The polymerized product of a particular ethylenically unsaturated polymerizable monomer, within the organic backbone, is called a "recurring unit." The various recurring units in the water-dispersible acrylic polymers used in the practice of this invention are distributed along the backbone of a given polymer in a random fashion, although blocks of common recurring units can be found but are not purposely formed along the organic backbone.

The terms "water-dispersible" and "water-dispersibility," when used to describe any of the acrylic polymers, polyesters, release agents, or any other components mentioned herein, mean that these materials are generally dispersed in an aqueous media during their manufacture or coating onto a support. The terms generally refer to the concept that the particular materials are supplied and used in the form of aqueous dispersions. Components described as being "water-dispersible" may not be soluble in the aqueous media and may not readily settle within the aqueous media. These terms do not refer to components, once coated and dried, as being re-dispersible in an aqueous medium. Rather, when "water-dispersible" components are dried on a support, they generally stay intact when contacted with water or aqueous solutions.

The term "antistat" means a water-dispersible conductive polymeric material (as described in more detail below).

Thermal Image Receiver Elements

Embodiments of thermal image receiver elements disclosed herein comprise an outermost image receiving layer on one or both (opposing) sides of a support (described below). In the single-layer DRL embodiment (FIG. 1A), the DRL is the outermost layer so that transfer of a dye, clear film, or metal can occur. In the embodiment shown in FIG. 1B, the outermost layer is a two-layer DRL/ROC combination. The ROC lies on top of the DRL. In the two-layer embodiment, both the ROC and DRL accept the transfer of dye, clear film, or metal donor material. In both the single-layer and two-layer embodiments, one or more additional layers (described below) can be located between the dye image receiving layer and the support. Moreover, in both the single-layer and two-layer embodiments, the DRL and ROC layers are formed as aqueous dispersions that are coated on one or both sides of the support. The following describes the components of such aqueous dispersions for the DRL and ROC layers.

Aqueous Coatable Dye-Receiving Layer

The dry image receiving layer (also referred to herein as an aqueous coatable dye-receiving layer or sometimes as an image receiving layer or more simply, as DRL) is the outermost layer in the single-layer thermal image receiver element embodiment and second most outer layer in the two-layer thermal image receiver element embodiment (the ROC lies on top of the DRL in that embodiment). The DRL generally has a $T_g$ of at least 25° C. and up to and including 70° C., or typically at least 35° C. and up to and including 70° C., or at least 35° C. and up to and including 60° C. Preferably the $T_g$ is 30° C. or less. The dry image receiving layer $T_g$ is measured as described above with differential scanning calorimeter (DSC) by evaluating the dry image receiving layer formulation containing a polymer binder matrix that comprises one or more of the following components: (1) a water-dispersible acrylic polymer, (2) a water-dispersible polyester, and (3) water-dispersible conductive polymeric material.

The aqueous coatable dye-receiving layer has a dry thickness of at least 0.1 μm and up to and including 5 μm, and typically at least 0.5 μm and up to and including 3 μm. In certain embodiments the aqueous coatable dye-receiving layer has a dry thickness of 1.2 μm to 1.5 μm, while in other embodiments, the DRL has a dry thickness of 0.7 μm to 1 μm. This dry thickness is an average value measured over at least 10 places in an appropriate electron scanning micrograph or other appropriate means and it is possible that there can be some places in the layer that exceed the noted average dry thickness.

The aqueous coatable dye-receiving layer comprises a polymer binder matrix that consists essentially of (1) a water dispersible acrylic polymer and (2) a water dispersible polyester. In the single-layer DRL embodiment, a water dispersible conductive polymeric material (also referred to herein as conductive polymer or antistat) may additionally be included in the DRL.

Polymer Binder Matrix Component—(1) Water Dispersible Acrylic Polymer

Regarding the one or more water-dispersible acrylic polymers in the polymer binder matrix of the aqueous DRL, each comprises chemically reacted or chemically non-reacted hydroxyl, phospho, phosphonate, sulfo, sulfonate, carboxy, or carboxylate groups, and particularly chemically reacted or chemically non-reacted carboxy or carboxylate groups. The term water-dispersible acrylic polymers includes styrene acrylic copolymers. For example, the water-dispersible acrylic polymer can be crosslinked (generally after the image receiving layer formulation has been applied to the support) through hydroxyl or carboxy groups to provide aminoester, urethane, amide, or urea groups. Mixtures of these water-dispersible acrylic polymers can be used if desired, having the same or different reactive groups.

Such water-dispersible acrylic polymers can be designed from one or more ethylenically unsaturated polymerizable monomers that will provide the desired properties of the resulting dry image receiving layer ($T_g$, crosslinkability, resistance to transferred dye fade, and thermal transferability). Generally, the useful water-dispersible acrylic polymers comprise recurring units that are derived predominantly (greater than 50 mol %) from one or more ethylenically unsaturated polymerizable monomers that provide the desired properties. The remainder of the recurring units can be derived from different ethylenically unsaturated polymerizable monomers.

For example, the water-dispersible acrylic polymer comprises recurring units derived from a combination of: (a) one or more ethylenically unsaturated polymerizable acrylates or methacrylates comprising acyclic alkyl ester, cycloalkyl ester, or aryl ester groups; (b) one or more carboxy-containing or sulfo-containing ethylenically unsaturated polymerizable acrylate or methacrylate, and (c) optionally styrene or a styrene derivative.

The acyclic alkyl ester, cycloalkyl ester, or aryl ester groups can be substituted or unsubstituted, and they can have up to and including 14 carbon atoms. The acyclic alkyl ester groups comprise linear and branched, substituted or unsubstituted alkyl groups including aryl-substituted alkyl groups, and aryloxy-substituted alkyl groups and can have at least 1 carbon atom and up to and including 22 carbon atoms. The cycloalkyl ester groups generally have at least 5 carbon atoms and up to and including 10 carbon atoms in the ring, and can be substituted or substituted cyclic ester groups including alkyl-substituted cyclic ester rings. Useful aryl ester groups include phenyl ester and naphthyl ester groups, which can be substituted or unsubstituted with one or more groups on the aromatic rings.

Representative examples of (a) ethylenically unsaturated polymerizable acrylates or methacrylates include but are not limited to, n-butyl acrylate, n-butyl methacrylate, t-butyl acrylate, t-butyl methacrylate, benzyl acrylate, benzyl methacrylate, 2-phenoxyethyl acrylate, stearyl methacrylate, cyclohexyl acrylate, cyclohexyl methacrylate, isobornyl methacrylate, 2-chloroethyl acrylate, benzyl 2-propyl acrylate, n-butyl 2-bromoacrylate, phenoxyacrylate, and phenoxymethacrylate. Particularly useful (a) ethylenically unsaturated polymerizable acrylates and methacrylates include benzyl acrylate, benzyl methacrylate, t-butyl acrylate, and 2-phenoxyethyl acrylate.

Representative (b) hydroxy-, phospho-, carboxy- or sulfo-containing ethylenically unsaturated polymerizable acrylates and methacrylates include but are not limited to, acrylic acid, sodium salt, methacrylic acid, potassium salt, 2-acrylamido-2-methylpropane sulfonic acid, 2-acrylamido-2-methylpropane sulfonic acid, sodium salt, 2-sulfoethyl methacrylate, sodium salt, 3-sulfopropyl methacrylate, sodium salt, and similar compounds. Acrylic acid and methacrylic acid, or salts thereof, are particularly useful so that the water-dispersible acrylic polymers comprise chemically reacted or chemically non-reacted carboxy or carboxylate groups.

The (c) ethylenically unsaturated polymerizable monomers include but are not limited to styrene, α-methyl styrene, 4-methyl styrene, 4-acetoxystyrene, 2-bromostyrene, α-bromostyrene, 2,4-dimethylstyrene, 4-ethoxystyrene, 3-trifluoromethylstyrene, 4-vinylbenzoic acid, vinyl benzyl chloride, vinyl benzyl acetate, and vinyl toluene. Styrene is particularly useful.

In these water-dispersible acrylic polymers, the (a) recurring units generally represent at least 20 mol % and up to and including 99 mol % of the total recurring units, or more typically at least 30 mol % and up to and including 98 mol % of the total recurring units in the polymer.

The (b) recurring units generally represent at least 1 mol % and up to and including 10 mol %, and typically at least 2 mol % and up to and including 5 mol %, of the total recurring units in the polymer.

In some embodiments, it is desirable to have low amounts of pendant acid groups in the water-dispersible acrylic polymers, such that the recurring units derived from the (a) recurring units comprise at least 1 mol % and up to and including 3 mol %, based on the total recurring units in the polymer.

When the (c) ethylenically polymerizable monomers are used to prepare the water-dispersible acrylic polymers, the recurring units derived from those monomers are generally present in an amount of at least 30 mol % and up to and including 80 mol %, or typically at least 50 mol % and up to and including 70 mol %, of the total recurring units in the polymer.

The water-dispersible acrylic polymers used in the practice of this invention can be prepared using readily available reactants and known addition polymerization conditions and free radical initiators. The preparation of some representative copolymers used in the present invention is provided below and in Table I and II. For example, some useful water-dispersible acrylic polymers can be obtained from Fujikura (Japan), DSM, and Eastman Kodak Company. Generally, the water-dispersible acrylic polymers are provided as aqueous dispersions. Useful water-dispersible acrylic polymers also generally have a number average molecular weight ($M_n$) of at least 5,000 and up to and including 1,000,000, as measured using size exclusion chromatography. Useful water dispersible acrylic polymers include, but are not limited to NeoCryl™ A-6092, NeoCryl™ XK-22-, NeoCryl™ 6092, and NeoCryl™ 6015, Dow® AVANSE MV-100, AVANSE 200, RHOPLEX™ acrylic product series, such as, Phoplex 585, HG-706, VSR-50, Z-Clean 1500, Lubrizol Carboset and Carbotac acrylic product series, Arkema® ENCOR All-Acrylic emulsions and SNAP acrylic polymers, such as, SNAP 720 and 728, etc. In certain embodiments mixtures of polymers are used (see herein below). Sometimes the water-dispersible acrylic polymers are referred to herein as "acrylic latex" or "acrylic polymer latex."

In some embodiments, the thermal image receiver elements include the water-dispersible acrylic polymer that comprises recurring units derived from: (a) one or more ethylenically unsaturated polymerizable acrylates or methacrylates comprising acyclic alkyl, cycloalkyl, or aryl ester groups having at least 4 carbon atoms, (b) one or more carboxy-containing or sulfo-containing ethylenically unsaturated polymerizable acrylate or methacrylate, and (c) optionally styrene or a styrene derivative, and wherein the (a) recurring units represent at least 10 mol % and up to and including 99 mol % of the total recurring units, and the (b) recurring units represent at least 1 mol % and up to and including 10 mol %.

For example, the water-dispersible acrylic polymer in the dry image receiving layer can be crosslinked through hydroxyl or carboxy groups using a suitable crosslinking agent (described below) to provide aminoester, urethane, amide, or urea groups.

The one or more water-dispersible acrylic polymers are present in an amount of at least 55 weight %, and typically at least 60 weight % and up to and including 80 weight % or 90 weight %, based on the total dry image receiving layer weight.

Polymer Binder Matrix Component—(2) Water-Dispersible Polyester

Each of the one or more water-dispersible polyesters that are present in the polymer binder matrix has a $T_g$ of 30° C. or less, or typically a $T_g$ of at least −10° C. and up to and including 30° C., or even at least 0° C. and up to and including 20° C. Preferably the water-dispersible polyester has a $T_g$ of 30° C. or less. In general, the water-dispersible polyester is a film-forming polymer that provides a generally homogeneous film when coated as dried. Such polyesters can comprise some water-dispersible groups such as sulfo, sulfonate, carboxyl, or carboxylate groups in order to enhance the water-dispersibility. Mixtures of these water-dispersible polyesters can be used together. Useful water-dispersible polyesters can be prepared using known diacids by reaction with suitable diols. In many embodiments, the diols are aliphatic glycols and the diacids are aromatic diacids such as phthalate, isophthalate, and terephthalate, in a suitable molar ratio. Mixtures of diacids can be reacted with mixtures of glycols. Either or both of the diacid or diol can comprise suitable sulfo or carboxy groups to improve water-dispersibility. A commercial source of a useful water-dispersibility polyester is described in the Examples below. Two useful water-dispersible polyesters are copolyesters of isophthalate and diethylene glycol, and a copolymer formed from a mixture of isophthalate and terephthalate with ethylene glycol and neopentyl glycol. An exemplary polyester is Vylonal® MD-1480, available from Toyobo®. Other water-dispersible co-polyesters are Vylonal® MD-1400, MD-1335, MD-1930, MD-1985, etc. also available from Toyobo®, and Eastman AQ 1350, AQ 1395, AQ 2350, and Eastek 1400, etc. available from Eastman.

The useful water-dispersible polyesters useful in the present invention can be obtained from some commercial sources such as Toyobo® (Japan) and Eastman Chemical Company, and can also be readily prepared using known starting materials and condensation polymerization conditions.

In addition, the one or more water-dispersible acrylic polymers are present in the polymer binder matrix at a dry ratio to the water-dispersible polyester of at least 1:1, or typically at least 1:1 up to and including 6:1, or more likely at least 1.5:1 up to and including 4:1. Preferably, the one or more water-dispersible acrylic polymers are present in the polymer binder matrix at a dry ratio to the water-dispersible polyester of at least 1:1 up to and including 9.2:1. In certain embodiments, the one or more water-dispersible acrylic polymers are present in the polymer binder matrix at a dry ratio to the water-dispersible polyester of at least 1:1, or at least 4:1 and up to and including 20:1, or at least 1:1 up to and including 20:1, or at least 4:1 up to and including 15:1.

Aqueous Coatable Receiver Overcoat Layer

The receiver overcoat layer is the outermost layer in the double-layer thermal image receiver element embodiment. This layer is not present in the single-layer DRL embodiment. The aqueous coatable receiver overcoat layer has a dry thickness of at least 0.1 μm and up to and including 5.0 μm, and typically at least 0.2 μm and up to and including 1.0 μm. In certain embodiments the aqueous coatable receiver overcoat layer has a dry thickness of 0.2 μm to 0.4 μm, while in other embodiments, the ROC has a dry thickness of 0.4 μm to 0.7 μm, or about 0.62 μm. According to the two-layer DRL/ROC embodiment (FIG. 1B), the combined thickness of the aqueous coatable ROC and aqueous coatable DRL is about 0.8 μm to 2.0 μm, or more specifically 1.0 μm to 1.2 μm.

The aqueous coatable receiver overcoat layer formulation comprises a polymer binder matrix composition that consists essentially of the (1) water-dispersible acrylic polymer and (2) water-dispersible polyester that were described with reference to the DRL, in all of the same respects. Thus, the previous discussion of the polymer binder matrix components is incorporated here by reference in relation to the ROC. The ROC additionally comprises water-dispersible conductive polymeric material component (as described below), as well as additional surfactants and optional addenda such as a surfactant used in the emulsification of the water-dispersible acrylic polymer, one or more release agents, one or more crosslinking agents, and any other addenda described herein. The weight ratio of the water-dispersible acrylic polymer to the water-dispersible polyester in such formulations is at least 1:1 to and including 6:1, or typically at least 1.5:1 to and including 5:1. Preferably the weight ratio of the water-dispersible acrylic polymer to the water-dispersible polyester in such formulations is at least 1:1 to and including 9.2:1. In certain embodiments, the one or more water-dispersible acrylic polymers are present in the polymer binder matrix at a dry ratio to the water-dispersible polyester of at least 1:1, or typically at least 4:1 and up to and including 20:1, or more likely at least 1:1 and up to and including 20:1, or even at least 4:1 and up to and including 15:1.

Water-Dispersible Conductive Polymeric Material

In the single-layer DRL embodiment, water-dispersible conductive polymeric material is present in the DRL. In the two-layer ROC/DRL embodiment, water-diserpsible conductive polymeric material is only added to the ROC. Exemplary water dispersible conductive polymeric materials include thiophenes such as Poly(3,4-ethylendioxythiophene)-poly(styrenesulfonate), known as PEDOT or PEDT. Baytron® P and Clevios® P are commercially available PEDOT solutions that are an aqueous solution that is 1.3% of the conjugated polymer PEDOT:PSS. PSS stands for poly(styrenesulfonate).

The PEDOT:PSS conjugate is mixed with an alcohol such as diethylene glycol or any other polar solvent, which enhances the conductivity of the conjugated PEDOT:PSS polymer. PEDOT:PSS is a conjugated polymer that carries positive charges and yet is still optically transparent. The multi-layered conductive thermal image receiver element of the present invention provides excellent electrical conductivity to enable efficient and effective dissipation of the electrostatic charge that is normally generated during the media transport and image forming process. This buildup of static charge causes undesirable print defects, such as white dropouts and creasing on the actual printed image. The present invention eliminates the buildup of static charge, leads to better print quality and improves the stacking and handling of the prints.

Another benefit to the present invention is that it can be used in all printers and thus can be considered a universal printer media that can be used in many types of printers, including thermal printers.

Figure 1B:
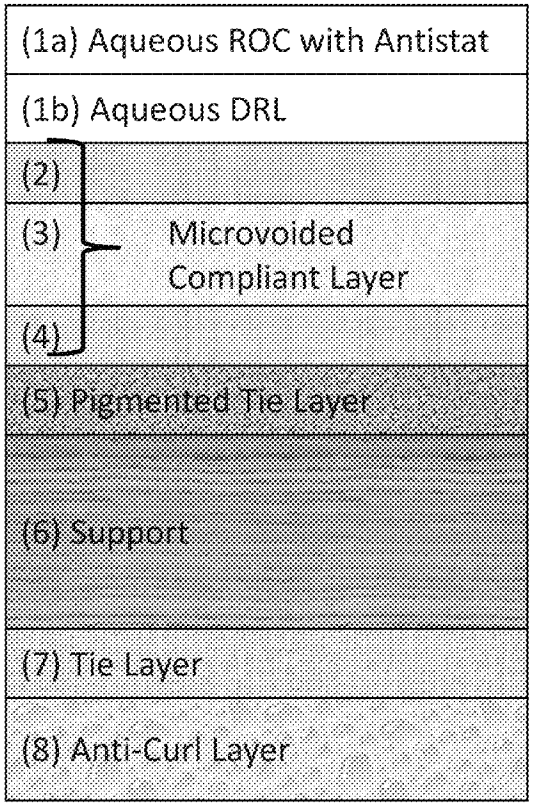

The water dispersible conductive polymeric material may be present in the DRL (single-layer embodiment) or the ROC (two-layer embodiment) in an amount ranging from 0.5% to 3.0%, or more specifically, from 1.0% to 2.0% or 1.5% to 2.5% by mass based on the dry mass of the respective layer to which the conductive polymer is added. As mentioned previously, in certain embodiments, the water dispersible conductive polymeric material is added to the dye-receiving layer, while in other embodiments, such material is added to the receiver overcoat layer. For example, referring to FIG. 1B, conductive polymeric material may be added to the ROC layer and not the DRL layer. In practice, the ROC and DRL layers shown in FIG. 1B are coated almost simultaneously. As a result, material in the ROC leaches into the DRL, including the conductive polymeric material. Specifically referring to the two-layer embodiment (FIG. 1B), the water dispersible conductive polymeric material may be present in the receiver overcoat layer in an amount equal to or greater than 1% by dry mass, or alternatively, in an amount equal to or greater than 1.4% by dry mass. In certain other embodiments, the conductive polymeric material may also be present in the receiver overcoat in an amount at a range of 1.2% to 3% or at a range of 1% to 3%. In yet other embodiments, the water dispersible conductive polymeric material is present in the ROC at a concentration of greater than or equal to 10.76 mg/cm$^3$.

FIG. 2 provides exemplary polymer binder matrix compositions where the water dispersible conductive polymeric material is present within the aqueous coatable dye-receiving layer for single-layer DRL embodiments—i.e., none of the samples in FIG. 2 had an ROC layer. C1-C6 represent control samples, whereas E1-E2 represent examples according to the invention. For control examples C1-C4, conductive polymeric material was added to sub-layers and not to the DRL. While all four samples exhibited no buckling and no creasing, all but C1 suffered from image bleeding. Image bleeding was measured after one week at variable conditions: 35° C./50% relative humidity; 40° C./50% relative humidity; and 50° C./50% relative humidity. Control sample C1 did not suffer from either buckling/creasing or image bleeding. However, to achieve such results, it was required to increase the thickness of the DRL significantly. Control examples C5 and C6 did not include any conductive polymeric material in the DRL and both test samples resulted in undesirable buckling and creasing. For invention examples E1 and E2, conductive polymeric material was added to the DRL, as opposed to the sub-layers. Both E1 and E2 exhibited no buckling, no creasing, and no image bleeding. Yet, the DRL thickness was held at 1.4 μm and a significantly less amount of conductive material was required. Therefore, by adding conductive polymeric material to the DRL, the inventors were able to avoid undesirable buckling, creasing, and image bleeding without having to sacrifice the thinness of the DRL and without having to add a significant amount of conductive material. The surface electrical resistance ("SER") of each sample was also tested. During printing, it is advantageous to maintain low surface resistivity to dissipate static electricity. As can be seen in FIG. 2, adding conductive polymeric material to the DRL helps with achieving this desired result.

FIG. 3 provides exemplary polymer binder matrix compositions where the water dispersible conductive polymeric material has been added to the receiver overcoat layer, which is placed over the aqueous coatable dye-receiving layer (for two-layer ROC/DRL structure). C8-C13 represent control samples, whereas E3-E9 represent examples according to the invention. Like the samples tested in FIG. 2, the samples detailed in FIG. 3 were observed for surface electrical resistance, buckling/creasing effects, and effects on image quality. For all of the samples (C8-C13 and E3-E9), conductive polymeric material was added to the ROC. As can be seen in samples C8-C13 in FIG. 3, when conductive material was added in an amount of 1.2% or less, by dry mass, buckling, creasing, and susceptibility to spots was observed. By increasing the amount of conductive polymeric material in the ROC to greater than 1.2%, desired results were achieved—namely, no buckling, no creasing, and no susceptibility to white dropouts or spots.

The polymer binder matrix forms the predominant structure of both the dye-receiving layer and the receiver overcoat layer and contains essentially no other polymers but (1) the water-dispersible acrylic polymer and (2) the water-dispersible polyester. and (3) the water-dispersible conductive polymeric material described above. However, lesser amounts (typically, less than 10 weight % of the total dry weight of the respective layer) of one or more other polymers or components can be added into the aqueous ROC and DRL dispersions to achieve further desired results. For example, such additional components may include conductive polymeric material (described previously), as well as crosslinking agents, release agents, additional surfactant, and dispersants (discussed more fully below).

Other Components—Water-Dispersible Release Agents

In some embodiments, the aqueous coatable dye-receiving layer and/or the receiver overcoat layer comprises one or more water-dispersible release agents that can reduce sticking that occurs between a thermal donor element and the thermal image receiver element of this invention during thermal imaging. These compounds are generally not water-soluble, but are water dispersible so that they are dispersed uniformly within the aqueous image receiving layer formulation (described above). Release agents can also help provide a uniform film in the dry image receiving layer during formulation and drying. These compounds can be polymeric or non-polymeric, but are generally polymeric. Such compounds are not generally re-dispersible once they are coated and dried in the aqueous coatable dye-receiving layer.

Useful water-dispersible release agents include but are not limited to, water-dispersible fluorine-based surfactants, silicone-based surfactants, modified silicone oil (such as epoxy-modified, carboxy-modified, amino-modified, alcohol-modified, fluorine-modified, alkylarylalkyl-modified, and others known in the art), and polysiloxanes. Useful modified polysiloxanes include but are not limited to, water-dispersible polyoxyalkylene-modified dimethylsiloxane graft copolymers having at least one alkylene oxide pendant chain having more than 45 alkoxide units, as described in U.S. Pat. No. 5,356,859 (Lum et al.) that is incorporated herein by reference. Other useful release agents include crosslinked amino modified polydimethylsiloxanes that can be supplied as emulsions under the tradename Siltech® from Siltech Corporation. Some useful commercial products of this type are described below in the Examples.

The useful amounts of one or more water-dispersible release agents in the dry image receiving layer are generally at least 0.5 weight % and up to and including 10 weight %, or typically at least 1 weight % and up to and including 5 weight %, based on the total weight of the dry image receiving layer. The amount of water-dispersible release agent refers to the amount of the compound, not the amount of a formulation or emulsion in which the compound may be supplied.

The aqueous coatable dye-receiving layer and receiver overcoat layer can also include residual crosslinking agents. Most of the crosslinking agents used in the image receiving layer formulation are reacted during the preparation of the thermal image receiver element, but some may be residual in the aqueous coatable dye-receiving layer. Useful crosslinking agents are described below.

Other Components—Crosslinking Agents

Useful crosslinking agents that can be included in the aqueous image receiving layer formulation and or the aqueous coatable receiver overcoat layer are chosen to be reactive with the particular reactive groups on the water-dispersible acrylic polymers incorporated into the polymer binder matrix. For example, for the reactive carboxyl and carboxylate groups, the useful crosslinking agents are carbodiimides and aziridines.

One or more crosslinking agents can be present in either or both of the aqueous image receiving layer formulation or aqueous receiver overcoat layer formulation in an amount that is essentially a 1:1 molar ratio or less with the reactive groups in the water-dispersible acrylic polymer in the formulation. In general, useful crosslinking agents include but are not limited to, organic compounds such as melamine formaldehyde resins, glycoluril formaldehyde resins, polycarboxylic acids and anhydrides, polyamines, epihalohydrins, diepoxides, dialdehydes, diols, carboxylic acid halides, ketenes, aziridines, carbodiimides, isocyanates, and mixtures thereof.

The aqueous coatable ROC and aqueous coatable DRL each may contain one more of any of the following additional addenda: plasticizers, antifoamers, coating aids, charge control agents, thickeners or viscosity modifiers, antiblocking agents, UV absorbers, coalescing aids, matte beads (such as organic matte particles), antioxidants, stabilizers, and fillers as is known in the art for aqueous-coated formulations These optional addenda can be provided in known amounts, including any amount in the range of 3% to 10% based on the total dry layer weight.

Additional and Excess Surfactant Added to DRL and ROC

The receiver overcoat layer comprises a polymer binder matrix consisting essentially of (1) a water-dispersible acrylic polymer and (2) a water-dispersible polyester, as well as (3) a water-dispersible conductive polymeric material. The ROC layer may further comprise one or more release agents, one or more crosslinking agents, one or more antifoamers, and one or more surfactants or emulsifiers. In certain preferred embodiments, an amount of surfactant is added to the aqueous ROC dispersion. Namely, surfactant is added to the ROC dispersion after the acrylic polymer is already formed, which is in addition to the amount of surfactant that is used as an emulsifier in the manufacture or suspension of the acrylic polymer. Hence, such added surfactant is sometimes referred to herein as "additional surfactant." One skilled in the art appreciates the fact that a surfactant/emulsifier is required to manufacture acrylic polymers with water dispersible properties.

In certain other embodiments, instead of adding "additional surfactant" after manufacturing the water-dispersible acrylic polymer, "excess surfactant" is added at the time that the acrylic polymer is made. This excess surfactant is an extra amount of surfactant in excess of what is required to actually make the acrylic polymer and is added at the time that the acrylic polymer is actually made. Generally, surfactant in the amount of 1% is required for the manufacture of acrylic polymers. Thus, "excess surfactant" is the amount of surfactant used to make the acrylic polymers that is in excess of 1%. For example, FIG. 5 provides samples where "excess surfactant" (excess of 1%) was added to the acrylic polymer composition and no "additional surfactant" was added to the ROC layer. Adding surfactant in the amount of 2-4 weight % (1-3% excess surfactant) at the time of formulating the acrylic polymer latex was shown to achieve acceptable results. Referring to FIG. 5, various types of acrylic polymers were tested by adding excess surfactant during the formulation of such acrylic polymers. The acrylic polymers that were tested were formulated with varying weight ratios of specific monomers. The ratios are listed in FIG. 5 as Group (c)/Group (a)/Group (b), where Group (c) monomers are styrene or styrene derivatives, Group (a) monomers are ethylenically unsaturated polymerizable acrylates or methacrylates comprising acyclic alkyl, cycloalkyl, or aryl ester groups having at least 4 carbon atoms, and Group (b) monomers are carboxy-containing or sulfo-containing ethylenically unsaturated polymerizable acrylate or methacrylate. Aside from the acrylic polymer composition and amount of excess surfactant added, all of the samples consisted of equal amounts of the same components.

The inventors determined, however, that it was far better to make the acrylic polymers with the "normal" or routinely required amounts of surfactant and then add in an "additional surfactant" into the ROC. This provided better results (less misregistrations, and allowed less surfactant to be used). Referring to FIG. 4, when the "additional" surfactant was added to the ROC and not added in the manufacture of the water-dispersible acrylic polymer as "excess surfactant," only about 2.5% by weight of surfactant was required to achieve the desired registration accuracy. FIG. 4 reveals that for samples C1-C9, no additional surfactant was added to the ROC. For all of those samples, misregistrations occurred and print quality was less than ideal. For samples E1-E7, various types of additional surfactant were added in an amount of 2.5% by mass based on the total dry image receiving layer weight. For each of examples E1-E7, misregistration was reduced, or entirely eliminated, and print quality was acceptable.

Useful surfactants are anionic or non-ionic surfactants. Useful anionic surfactants include, but are not limited to, the following: Rhodocal® A-246 (Sodium C14-C16 sulfonate), Rhodapex® CO-436 (40% solids in 12-16% ethanol); DOWFAX 2A1 (alkyldiphenyloxide disulfonate), SDBS (Sodium Dodecyl Benzenesulfonate) and ADS (sodium dodecyl sulfate). Useful non-ionic surfactants, include, but are not limited to, the following: Olin-10G™ (P-isonoylphenoxypoly(glycidol)) or SILWET L-7230 (a copolymer of silicone, ethyleneoxide and propyleneoxide). The amount of "excess" or "additional" surfactant added to the formulation is in the range from 1% to 5% by weight, or 2% to 5% by weight, or by 3% to 4% by weight. In certain embodiments the additional surfactant is added to the formulation at about 2.5% by weight, or 1% to 3% by weight, or 2% to 2.5% by weight, or 2% to 3% by weight.

By adding a surfactant to the ROC, the inventors were able to reduce the number of misregistrations. Because misregistrations appear to happen more frequently at the end of the donor ribbon spool, the inventors judged visual registration and registration accuracy by testing and analyzing the last section of prints of a donor spool (for example, the last 50 pages when the donor spool normally would print about 250 prints). As one skilled in the art would appreciate, when there is a misregistration, the print quality is reduced as the lines, edges, or boundaries are fuzzy and not sharp. Moreover, misregistrations cause the edges or boundaries to be incorrectly colored because of incorrect overlap of the various colors of the donor element that are transferred to the receiver element. For example, when the desired color is green, the blue and yellow dye are transferred to the receiver element on top of each other. When there is a misregistration, the edges or boundaries of the print may appear either yellow or blue, instead of green, because there was not a perfect overlap of the blue and yellow dye to achieve the green color.

Other Components—Antifoamers

For an aqueous dispersion system that is loaded with surface active agents in the form of emulsifiers, surfactants, dispersants, or the like, foams are easily generated during the preparation of dispersions and during any subsequent coating application process. Foaming occurs particularly when dispersions, like the ones discussed previously, undergo high shearing processes. High shearing processes include high-speed stirring at about 1000 rpm (revolution per minute) or greater and high-speed coating application at about 150 mpm (meter per minute) or greater. During a high shearing process, an objectionable amount of foam is generated, which usually causes coating defects, unwanted compositional fluctuation, and messy overflow, among other undesirable effects. Moreover, excess foaming requires one to frequently change the filters of the coating equipment. To address these problems, it is advantageous to incorporate an appropriate amount of one or more antifoamers into the aqueous dispersions for the ROC and DRL layers. The inventors discovered that the addition of certain antifoamers at certain amounts effectively suppresses and controls the foaming activity of an aqueous DRL dispersion that is subjected to high shearing processes. Antifoamers described herein are generally water-dispersible with varying degree of hydrophilicity/hydrophobicity balance. In addition, they are typically (if not always) incorporated with organic (e.g., amides, wax, liquid hydrocarbon, etc.) and/or inorganic particulates (e.g., fumed silica, colloidal silica, etc.) with varying degree of hydrophilicity/hydrophilicity balance as well. Useful antifoamers include compounds with high silicone content, such as structured siloxane antifoamers, polyorganosiloxane, resinous siloxane compounds, and polyether siloxane copolymers. Useful antifoamers include, but are not limited to, the commercially available antifoamers listed in FIG. 7.

FIG. 7 is a table showing how various concentrations of various types of antifoamers affect the foam height above initial liquid level after the aqueous dispersion has been subjected to a high shearing process. The sample dispersions each underwent high-speed mixing at 2000 rpm for two minutes. Foam height measurements were taken immediately after the mixing process ended ("0 minutes after 2 min mix"), one minute after the mixing process ended, and two minutes after the mixing process ended. As shown in FIG. 7, control dispersion sample C1 did not include an antifoamer, and as expected, the foam height above initial liquid level was at one of the highest levels observed of any sample. Moreover, the foam remained at a level of about 5.1 cm above the initial liquid level after a two-minute wait time that followed the conclusion of a high shearing stirring process. Dispersion samples F1-F17 each included an antifoamer at varying amounts, but none of those dispersion samples effectively reduced foam levels after a high shearing stirring process. Dispersion samples E10-E30, on the other hand, proved more effective at reducing foam levels after a high shearing stirring process. The results in FIG. 7 evidence that certain types of antifoamers effectively reduce foam levels after high shearing processes, whereas other types of antifoamers do not effectively reduce foam levels. Aside from the type of antifoamer, the antifoamer diluent used, and the amount of antifoamer used, each of the DRL dispersion samples listed in FIG. 7 comprise all of the same components—namely, a water-dispersible acrylic polymer, a water-dispersible polyester, a release agent, a cross-linking agent, and a surfactant.

Similarly, FIG. 6 is a table showing how various concentrations of various types of antifoamers affect the foam height above the initial liquid level of several aqueous DRL dispersions. All of the dispersion samples E1-E12 and C13-C14 are aqueous DRL dispersions comprising the same cross-linking agent, release agent, water-dispersible polyester, and water-dispersible acrylic polymer. For each of the dispersion samples listed in FIG. 6, the weight ratio of water-dispersible acrylic polymer to water-dispersible polyester present was roughly 9:1, and the water-dispersible acrylic polymer consisted of about 3% by weight of Group (b) monomers—carboxy-containing or sulfo-containing ethylenically unsaturated polymerizable acrylate or methacrylate. The two control dispersion samples (C13 and C14) did not include an antifoamer. As expected, the foam height for the two control samples was much higher than the foam height for the exemplary samples (E1-E12), which all included some type of antifoamer. Samples E7-E12 each displayed very desirable results, as the foam was reduced entirely just two minutes after mixing. As shown in FIGS. 6 and 7, it is advantageous to add antifoamers to the DRL in an amount equal to or greater than 0.04 weight %, or in a range of 0.04 to 0.32 weight %, or in an amount ranging from 0.16 to 0.32 weight %.

The several aqueous DRL dispersion embodiments of FIG. 6 also comprise at least one surfactant and/or dispersant (except for control example C13, which does not comprise any surfactant or dispersant). Dispersing agents, also known as dispersants, are typically materials that strongly adsorb on to pigment particles. To provide optimal performance, pigment particles must act independently of each other and thus must remain well dispersed throughout manufacture, storage, application, and film formation. To achieve these advantageous properties, certain embodiments of the present invention have a DRL that comprises one or more surfactants in combination with one or more dispersants. The one or more surfactants may be present in an amount up to approximately 10 weight % based on the total dry weight of the DRL, or more specifically 1 to 6 weight %. Similarly, the one or more dispersants may be present in an amount up to approximately 10 weight % based on the total dry weight of the DRL, or more specifically from 1 to 3 weight %.

As illustrated in FIG. 6, all of the dispersion samples except for E10 and C13 include the surfactant Olin-10G™. In addition, FIG. 6 illustrates certain aqueous DRL embodiments that comprise Olin-10G™ in combination with one or more dispersants. Useful dispersants are described below with reference to FIG. 8, and FS-30, which is commercially available from multiple raw material suppliers (e.g., Castament® FS-30 by BASF and Capstone® FS-30 by DUPONT).

ROC Filterability

In certain embodiments, as described previously, dispersants or surfactants are employed in the ROC and DRL to enhance the dispersion stability. The inclusion of one or more surfactants and one or more dispersants in the ROC also improves filterability. It should be appreciated that variations of the thermal receiver element of the present invention may contain just one or more surfactants, just one or more dispersants, or a combination thereof in the ROC. Unwanted dispersed particle build-up and coagulation of ROC dispersions may be observable in a coating machine during or after high-speed, high-sheer coating processes. The presence of build-up in the form of deposits and agglomerates requires frequent cleaning of coating machinery and filter changes during the coating application process. Failure to monitor such build-up and maintain clean machinery can affect the coating quality as a result. The inventors discovered that by incorporating suitable type and amount of dispersants can significantly enhance the dispersion stability with improved filterability. Dispersants protect the latex and dispersed particulates (or non-continuous phase particles) in the ROC dispersion from being coagulated, flocculated, agglomerated, and coalesced under high shear and high stress condition.

The dispersants used in this invention are usually random or block copolymers or terpolymers. They may be ionic or nonionic and have a weight average molecular weight ranging from 5000 to 100,000. In the case that the dispersant is a random or block copolymer, the copolymer is usually comprised of two types of monomeric constituents: one hydrophilic monomeric constituent and one hydrophobic and/or lipophilic monomeric constituent—such as, aliphatics, aromatics, alicyclics, aromatic heterocycles, alicyclic heterocycles, polycyclics, or the like. In the case that the dispersant is a random or block terpolymer, it is also comprised of two types of monomeric constituents: at least one (but no more than two) hydrophilic monomeric constituents and at least one (but no more than two) hydrophobic and/or lipophilic monomeric constituents—such as, aliphatics, aromatics, alicyclics, aromatic heterocycles, alicyclic heterocycles, polycyclics, and silicone- and/or fluoro-containing aliphatics, aromatics, alicyclics, aromatic heterocycles, alicyclic heterocycles, polycyclics, or the like.

The above mentioned characteristics of dispersants can be exemplified as follows: for instance, a random copolymer of benzyl methacrylate and methacrylic acid (such as BE-23), a random terpolymer of benzyl methacrylate, octadecyl methacrylate, and methacrylic acid (such as BOE), and an acrylic block copolymer or terpolymer, (such as Efka® PX 4701 and Dispex® Ultra PX 4585 from BASF). Moreover, other useful polymeric dispersants include E-SPERSE 100 and E-SPERSE 700 from Ethox Chemicals, the Zetasperse® aqueous dispersant series from Air Products®, the Solsperse® aqueous hyperdispersant series from Lubrizol®, and the Zephrym™ aqueous dispersant series from CRODA.

Filterability testing was conducted and the results are detailed in FIG. 8. FIG. 8 shows the filterability of various ROC dispersions based on the filtrate quality testing ("FQT") method, which is quantified by the weight to plug ("WTP") metric. To perform the FQT method, a solution sample is run through a test filter at constant pressure. The filtrate is collected and weighed until the aqueous solution flow stops. The total weight of the filtrate collected when the flow of the solution stops is recorded as the WTP (results in FIG. 8 are expressed in grams). The higher the WTP, the better the filterability. The filterability of the dispersion samples in FIG. 8 were tested using a 32 mm diameter, 1.2 micron membrane filter. The quantitative FQT results measured by WTP are detailed in the second to last column in FIG. 8. Based on internal testing, the inventors determined that certain quantitative results yielded less than acceptable results. The inventors thus created a qualitative scale by which to rank and evaluate the various ROC dispersions that were tested. Qualitative evaluations of the ROC dispersions are provided in the last column in FIG. 8. The quantitative-to-qualitative translation is as follows:

| FQT/WTP (gm) | Filterability Ranking |
|---|---|
| N < 5 | Not Acceptable to Marginally Acceptable |
| 5 < N < 20 | Marginally Acceptable to Acceptable |
| 20 < N < 70 | Acceptable to Very Good |
| N > 70 | Very Good to Excellent |

Referring still to FIG. 8, the components of each dispersion sample are detailed by the data listed in columns numbered 1 to 10. Water is a component of all of the ROC dispersions that were tested, as shown in column 1 In column 2, "L-3% E" represents that a water dispersible acrylic polymer was added to the dispersion. The "L-3% E" represents that the acrylic latex ("L") is comprised of 3% of (b)-type carboxy-containing or sulfo-containing ethylenically unsaturated polymerizable acrylate or methacrylate monomers that were discussed previously. In column 3, "XL-1" represents that a cross-linking agent was added to the dispersion. In column 4, "P" represents that PEDOT, a water-dispersible conductive polymeric material, was added to the dispersion. In column 5, "S" represents that a release agent was added to the dispersion—namely, the commercially available release agent, Siltech®. In column 6, "V" represents that Vylonal® MD-1480, a film-forming water-dispersible polyester, was added to the dispersion. Columns 7 and 8 represent different solvents that were added to the dispersion samples. "IBA" represents the solvent isobutyl alcohol, whereas "DEG" represents diethylene glycol. Columns 9 and 10 illustrate the combinations of surfactants and dispersants present in the ROC dispersion. Previously discussed Olin-10G™ is usually used as a surfactant, whereas BE-23, BOE, Efka® PX 4701, E-SPERSE 100, and E-SPERSE 700 (all previously discussed) are used as dispersants. FIG. 8 illustrates that the ROC dispersion may include zero, one, or two dispersants. Dispersants can be included in the ROC in an amount ranging from 0.5% up to and including 10% by weight, or more specifically, 1% to 4% by weight, based on the total dry weight of the ROC layer. Upon drying the aqueous-coatable ROC and DRL formulations, it is understood that the solvents evaporate and do not account for any of the dry weight in either layer.

Microvoided Compliant Layer

Dye receiver elements used in thermal dye transfer generally include a support (transparent or reflective) bearing on one or both sides thereof a dye image-receiving layer, and optionally additional layers, such as a compliant or cushioning layer between the support and the dye-receiving layer. FIGS. 1A and 1B show that the aqueous DRL layer lies on top of the microvoided compliant layer. In other embodiments (not shown in the figures), the dye-receiving layer may be coated directly on one or both opposing sides of a support. Alternatively, as seen in FIGS. 1A and 1B, the aqueous DRL may be coated on top of an additional layer (such as a compliant layer), which resides on one or both opposing sides of the support. The compliant layer provides insulation to keep heat generated by the thermal head at the surface of the print, and also provides close contact between the donor ribbon and receiving sheet, which is essential for uniform print quality. Various approaches have been suggested for providing such a compliant layer. FIGS. 1A and 1B illustrate that a similar microvoided compliant layer is included between the outermost layer and the support. One skilled in the art should appreciate that the microvoided compliant layer may comprise one or more layers, such as skin layers and film layers. The microvoided compliant layer shown in FIGS. 1A and 1B should be understood to be any type of compliant layer known in the art.

Support

The thermal image receiver elements comprise one or more layers as described above, disposed over a suitable support. As noted above, these layers can be disposed on one or both sides of the support. From the outermost surface to the support, the thermal image receiver elements comprise an aqueous coatable dye-receiving layer and optionally one or more intermediate layers. However, in many embodiments, the aqueous coatable dye-receiving layer is disposed directly on one or both sides of the support. A particularly useful support comprises a polymeric film or a raw paper base comprising cellulose fibers, or a synthetic paper base comprising synthetic polymer fibers, or a resin coated cellulosic paper base. But other base supports such as fabrics and polymeric films can be used. The support can be composed of any material that is typically used in thermal imaging applications as long as the layer formulations described herein can be suitably applied thereof.

The resins used on either or both sides of a paper base are thermoplastics like polyolefins such as polyethylene, polypropylene, copolymers of these resins, or blends of these resins, in a suitable dry thickness that can be adjusted to provide desired curl characteristics. The surface roughness of this resin layer can be adjusted to provide desired conveyance properties in thermal imaging printers.

The support can be transparent or opaque, reflective or non-reflective. Opaque supports include plain paper, coated paper, resin-coated paper such as polyolefin-coated paper, synthetic paper, low density foam core based support, and low density foam core based paper, photographic paper support, melt-extrusion-coated paper, and polyolefin-laminated paper.

The papers include a broad range of papers, from high end papers, such as photographic paper to low end papers, such as newsprint. In one embodiment, Ektacolor® paper (Eastman Kodak Co.) as described in U.S. Pat. No. 5,288,690 (Warner et al.) and U.S. Pat. No. 5,250,496 (Warner et al.), both incorporated herein by reference, can be used. The paper can be made on a standard continuous fourdrinier wire machine or on other modern paper formers. Any pulp known in the art to provide paper can be used. Bleached hardwood chemical kraft pulp is useful as it provides brightness, a smooth starting surface, and good formation while maintaining strength. Papers useful in this invention are generally of caliper of at least 50 μm and up to and including 230 μm and typically at least 100 μm and up to and including 190 μm, because then the overall imaged element thickness is in the range desired by customers and for processing in existing equipment. They can be "smooth" so as to not interfere with the viewing of images. Chemical additives to impart hydrophobicity (sizing), wet strength, and dry strength can be used as needed. Inorganic filler materials such as $TiO_2$, talc, mica, $BaSO_4$ and $CaCO_3$ clays can be used to enhance optical properties and reduce cost as needed. Dyes, biocides, and processing chemicals can also be used as needed. The paper can also be subject to smoothing operations such as dry or wet calendering, as well as to coating through an in-line or an off-line paper coater.

A particularly useful support is a paper base that is coated with a resin on either side. Biaxially oriented base supports include a paper base and a biaxially oriented polyolefin sheet, typically polypropylene, laminated to one or both sides of the paper base. Commercially available oriented and non-oriented polymer films, such as opaque biaxially oriented polypropylene or polyester, can also be used. Such supports can contain pigments, air voids or foam voids to enhance their opacity. The support can also comprise microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861 that is incorporated herein by reference. Useful composite sheets are disclosed in, for example, U.S. Pat. No. 4,377,616 (Ashcraft et al.), U.S. Pat. No. 4,758,462 (Park et al.), and U.S. Pat. No. 4,632,869 (Park et al.), the disclosures of which are incorporated by reference.

The support can be voided, which means voids formed from added solid and liquid matter, or "voids" containing gas. The void-initiating particles, which remain in the finished packaging sheet core, should be from at least 0.1 and up to and including 10 μm in diameter and typically round in shape to produce voids of the desired shape and size. Microvoided polymeric films are particularly useful in some embodiments. For example, some commercial products having these characteristics that can be used as support are commercially available as 350K18 from ExxonMobil and KTS-107 (from HSI, South Korea).

Biaxially oriented sheets, while described as having at least one layer, can also be provided with additional layers that can serve to change the properties of the biaxially oriented sheet. Such layers might contain tints, antistatic or conductive materials, or slip agents to produce sheets of unique properties. Biaxially oriented sheets can be formed with surface layers, referred to herein as skin layers, which would provide an improved adhesion, or look to the support and photographic element. The biaxially oriented extrusion can be carried out with as many as 10 layers if desired to achieve some particular desired property. The biaxially oriented sheet can be made with layers of the same polymeric material, or it can be made with layers of different polymeric composition.

Useful transparent supports can be composed of glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The term as used herein, "transparent" means the ability to pass visible radiation without significant deviation or absorption.

The support used in the thermal image receiver elements can have a thickness of at least 50 μm and up to and including 500 μm or typically at least 75 μm and up to and including 350 μm. Antioxidants, brightening agents, antistatic or conductive agents, plasticizers and other known additives can be incorporated into the support, if desired.

Useful antistatic agents in the substrate (such as a raw paper stock) include but are not limited to, metal particles, metal oxides, inorganic oxides, metal antimonates, inorganic non-oxides, and electronically conductive polymers, examples of which are described in U.S. Patent Application 2011/0091667 (noted above) that is incorporated herein by reference. Particularly useful antistatic agents are inorganic or organic electrolytes. Alkali metal and alkaline earth salts (or electrolytes) such as sodium chloride, potassium chloride, and calcium chloride, and electrolytes comprising polyacids are useful. For example, alkali metal salts include lithium, sodium, or potassium polyacids such as salts of polyacrylic acid, poly(methacrylic acid), maleic acid, itaconic acid, crotonic acid, poly(sulfonic acid), or mixed polymers of these compounds. Alternatively, the raw base support can contain various clays such as smectite clays that include exchangeable ions that impart conductivity to the raw base support. Polymerized alkylene oxides, such as combinations of polymerized alkylene oxide and alkali metal salts as described in U.S. Pat. No. 4,542,095 (Steklenski et al.) and U.S. Pat. No. 5,683,862 (Majumdar et al.) are useful as electrolytes.

The antistatic agents can be present in the support (such as a cellulose raw base support) in an amount of up to 0.5 weight % or typically at least 0.01 weight % and up to and including 0.4 weight % based on the total support dry weight.

In another embodiment, the base support comprises a synthetic paper that is typically cellulose-free, having a polymer core that has adhered thereto at least one flange layer. The polymer core comprises a homopolymer such as a polyolefin, polystyrene, polyester, polyvinylchloride, or other typical thermoplastic polymers; their copolymers or their blends thereof; or other polymeric systems like polyurethanes and polyisocyanurates. These materials can have been expanded either through stretching resulting in voids or through the use of a blowing agent to consist of two phases, a solid polymer matrix, and a gaseous phase. Other solid materials can be present in the form of fillers that are of organic (polymeric, fibrous) or inorganic (glass, ceramic, metal) origin.

In still another embodiment, the support comprises a synthetic paper that can be cellulose-free, having a foamed polymer core or a foamed polymer core that has adhered thereto at least one flange layer. The polymers described for use in a polymer core can also be employed in manufacture of the foamed polymer core layer, carried out through several mechanical, chemical, or physical means as are known in the art.

In a many embodiments, polyolefins such as polyethylene and polypropylene, their blends and their copolymers are used as the matrix polymer in the foamed polymer core along with a chemical blowing agent such as sodium bicarbonate and its mixture with citric acid, organic acid salts, azodicarbon-amide, azobisformamide, azobisisobutyrolnitrile, diazoaminobenzene, 4,4'-oxybis(benzene sulfonyl hydrazide) (OBSH), N,N'-dinitrosopentamethyl-tetramine (DNPA), sodium borohydride, and other blowing agent agents well known in the art. Useful chemical blowing agents would be sodium bicarbonate/citric acid mixtures, azodicarbonamide; though others can also be used. These foaming agents can be used together with an auxiliary foaming agent, nucleating agent, and a cross-linking agent.

Where the thermal image receiver element comprises an aqueous coatable dye-receiving layer on only one side of the support, it can be useful to apply a slip layer or anti-curl layer on the "backside" (non-imaging) of the support using suitable polymers such as acrylate or methacrylate polymers, vinyl resins such as copolymers derived from vinyl chloride and vinyl acetate, poly(vinyl alcohol-co-vinyl butyral), polyvinyl acetate, cellulose acetate, or ethyl cellulose. The backside slip layer can also comprise one or more suitable antistatic agents or anti-conductive agents that are known in the art. This slip layer can also include lubricants such as oils or semicrystalline organic solids such as beeswax. poly(vinyl stearyl), perfluorinated alkyl ester polyethers, polycaprolactone, silicone oils, or any combination thereof, as described for example in U.S. Pat. No. 5,866,506 (Tutt et al.) that is incorporated herein by reference. Useful anti-curl layers can comprise one or more polyolefins such mixtures of polyethylene and polypropylene.

Method of Making Image Receiver Elements (A) Preparation of Image Receiving Layer Having Aqueous Coatable Dye-Receiving Layer as the Outmost Layer (Single-Layer DRL with No Water-Dispersible Conductive Polymeric Material)

An image receiving layer was prepared by applying an aqueous coatable dye-receiving image receiving layer formulation to at least one side of a support, and in some embodiments, the same or different aqueous coatable dye-receiving layer formulations can be applied to opposing sides of a support to provide a duplex thermal image receiving element.

The applied aqueous coatable dye-receiving layer formulation comprises a polymer binder composition that consists essentially of the (1) and (2) polymer components described above and any optional addenda such as a surfactant used as an emulsifier for making the water-dispersible acrylic polymer, one or more release agents, one or more crosslinking agents and any other addenda described herein. The weight ratio of the water-dispersible acrylic polymer to the water-dispersible polyester in such formulations is at least 1:1 to and including 6:1, or typically at least 1.5:1 to and including 5:1. Preferably the weight ratio of the water-dispersible acrylic polymer to the water-dispersible polyester in such formulations is at least 1:1 to and including 9.2:1. In certain embodiments, the one or more water-dispersible acrylic polymers are present in the polymer binder matrix at a dry ratio to the water-dispersible polyester of at least 1:1, or typically at least 4:1 and up to and including 20:1, or more likely at least 1:1 and up to and including 20:1, or even at least 4:1 and up to and including 15:1. These formulations can be applied to the support using any useful technique including coating with appropriate equipment and conditions, including but not limited to hopper coating, curtain coating, rod coating, gravure coating, roller coating, dip coating, and spray coating. The support materials are described above, but before applying the aqueous coatable dye-receiving layer formulation, the support can be treated to improve adhesion using any suitable technique such as acid etching, flame treatment, corona discharge treatment, or glow discharge treatment, or it can be treated with a suitable primer layer.

(B) Preparation of Image Receiving Layer Having Conductive Polymer in an Aqueous Coatable Dye-Receiving Layer as Outmost Layer (Single-Layer DRL with Water-Dispersible Conductive Polymeric Material)

A conductive image receiving layer was prepared by applying an aqueous coatable dye-receiving image receiving layer formulation comprising a conductive polymer to at least one side of a support, and in some embodiments, the same or different aqueous coatable dye-receiving layer formulations can be applied to opposing sides of a support to provide a duplex thermal image receiving element.

The applied aqueous coatable dye-receiving layer formulation comprises a polymer binder composition that consists essentially of the (1) water-dispersible acrylic polymer, (2) water-dispersible polyester, and (3) water-dispersible conductive polymeric material components described above and any optional addenda such as one or more surfactants or dispersants used as an emulsifier for the water-dispersible acrylic polymer, one or more release agents, one or more crosslinking agents, and any other addenda described above. The weight ratio of the water-dispersible acrylic polymer to the water-dispersible polyester in such formulations is at least 1:1 to and including 6:1, or typically at least 1.5:1 to and including 5:1. Preferably the weight ratio of the water-dispersible acrylic polymer to the water-dispersible polyester in such formulations is at least 1:1 to and including 9.2:1. In certain embodiments, the one or more water-dispersible acrylic polymers are present in the polymer binder matrix at a dry ratio to the water-dispersible polyester of at least 1:1, or typically at least 4:1 and up to and including 20:1, or more likely at least 1:1 and up to and including 20:1, or even at least 4:1 and up to and including 15:1. The amount of the (3) water dispersible conductive polymeric material in the formulation ranges from >0.75% to 2% or 1.0% to 1.25%. These formulations can be applied to the support using any useful technique including coating with appropriate equipment and conditions, including but not limited to hopper coating, curtain coating, rod coating, gravure coating, roller coating, dip coating, and spray coating. The support materials are described above, but before applying the aqueous coatable dye-receiving layer formulation, the support can be treated to improve adhesion using any suitable technique such as acid etching, flame treatment, corona discharge treatment, or glow discharge treatment, or it can be treated with a suitable primer layer.

(C) Preparation of Image Receiving Layer Having Conductive Polymer in an Aqueous Coatable Overcoat Layer (Two-Layer DRL (ROC/DRL) with Water-Dispersible Conductive Polymeric Material in ROC Layer)

The image receiving layer is composed of two layers, namely, an aqueous coatable dye-receiving layer and an aqueous coatable overcoat layer comprising a conductive polymer.

The image layer was prepared by first applying an aqueous coatable dye-receiving image receiving layer formulation to at least one side of a support, and in some embodiments, the same or different aqueous coatable dye-receiving layer formulations can be applied to opposing sides of a support to provide a duplex thermal image receiving element.

The applied aqueous coatable dye-receiving layer formulation comprises a polymer binder composition that consists essentially of the (1) water-dispersible acrylic polymer and (2) water-dispersible polyester components described above and any optional addenda such as one or more surfactants or dispersants used as an emulsifier for making the water-dispersible acrylic polymer, one or more release agents, one or more crosslinking agents, and any other addenda described herein. The weight ratio of the water-dispersible acrylic polymer to the water-dispersible polyester in such formulations is at least 1:1 to and including 6:1, or typically at least 1.5:1 to and including 5:1. Preferably the weight ratio of the water-dispersible acrylic polymer to the water-dispersible polyester in such formulations is at least 1:1 to and including 9.2:1. In certain embodiments, the one or more water-dispersible acrylic polymers are present in the polymer binder matrix at a dry ratio to the water-dispersible polyester of at least 1:1, or typically at least 4:1 and up to and including 20:1, or more likely at least 1:1 and up to and including 20:1, or even at least 4:1 and up to and including 15:1.

These formulations can be applied to the support using any useful technique including coating with appropriate equipment and conditions, including but not limited to hopper coating, curtain coating, rod coating, gravure coating, roller coating, dip coating, and spray coating. The support materials are described herein, but before applying the aqueous coatable dye-receiving layer formulation, the support can be treated to improve adhesion using any suitable technique such as acid etching, flame treatment, corona discharge treatment, or glow discharge treatment, or it can be treated with a suitable primer layer.

Then, an overcoat layer was prepared by applying an aqueous coatable dye-receiving image receiving layer formulation comprising a conductive polymer overcoated to the dye-receiving layer at least on one side of a support coated with an aqueous coatable dye-receiving layer, and in some embodiments, the same or different aqueous coatable dye-receiving layer formulations comprising a conductive polymer can be applied to opposing sides of a support coated with an aqueous coatable dye-receiving layer to provide a duplex thermal image receiving element.

The applied aqueous coatable overcoat layer formulation comprises a polymer binder composition that consists essentially of the (1) water-dispersible acrylic polymer, (2) water-dispersible polyester, and (3) water-dispersible conductive polymeric material components described above and any optional addenda such as one or more surfactants or dispersants used as an emulsifier for making the water-dispersible acrylic polymer (described herein), one or more release agents, one or more crosslinking agents (described herein), and any other addenda described herein. The weight ratio of the water-dispersible acrylic polymer to the water-dispersible polyester in such formulations is at least 1:1 to and including 6:1, or typically at least 1.5:1 to and including 5:1. Preferably the weight ratio of the water-dispersible acrylic polymer to the water-dispersible polyester in such formulations is at least 1:1 to and including 9.2:1. In certain embodiments, the one or more water-dispersible acrylic polymers are present in the polymer binder matrix at a dry ratio to the water-dispersible polyester of at least 1:1, or typically at least 4:1 and up to and including 20:1, or more likely at least 1:1 and up to and including 20:1, or even at least 4:1 and up to and including 15:1. The amount of water dispersible conductive polymeric material in the formulation ranges from >1.2% to 3%, >1% to 3% by weight, >1% by weight, >1.4% by weight. These formulations can be applied to the support using any useful technique including coating with appropriate equipment and conditions, including but not limited to hopper coating, curtain coating, rod coating, gravure coating, roller coating, dip coating, and spray coating. The support materials are described above, but before applying the aqueous coatable dye-receiving layer formulation, the support can be treated to improve adhesion using any suitable technique such as acid etching, flame treatment, corona discharge treatment, or glow discharge treatment, or it can be treated with a suitable primer layer.

(D) Preparation of Image Receiving Layer Having Additional Surfactant and Conductive Polymer in an Overcoat Layer (Two-Layer DRL (ROC/DRL) with Additional Surfactant and Water-Dispersible Conductive Polymeric Material in the ROC Layer)

The image receiving layer is composed of two layers, namely, an aqueous coatable dye-receiving layer and an aqueous coatable overcoat layer comprising additional surfactant and conductive polymer.

The image layer was prepared by first applying an aqueous coatable dye-receiving image receiving layer formulation to at least one side of a support, and in some embodiments, the same or different aqueous coatable dye-receiving layer formulations can be applied to opposing sides of a support to provide a duplex thermal image receiving element.

The applied aqueous coatable dye-receiving layer formulation comprises a polymer binder composition that consists essentially of the (1) water-dispersible acrylic polymer and (2) water-dispersible polyester components described above and any optional addenda such as a surfactant used as an emulsifier used for making the water-dispersible acrylic polymer, one or more release agents, one or more crosslinking agents, and any other addenda described herein. The weight ratio of the water-dispersible acrylic polymer to the water-dispersible polyester in such formulations is at least 1:1 to and including 6:1, or typically at least 1.5:1 to and including 5:1. Preferably the weight ratio of the water-dispersible acrylic polymer to the water-dispersible polyester in such formulations is at least 1:1 to and including 9.2:1.

In certain embodiments, the one or more water-dispersible acrylic polymers are present in the polymer binder matrix at a dry ratio to the water-dispersible polyester of at least 1:1, or typically at least 4:1 and up to and including 20:1, or more likely at least 1:1 and up to and including 20:1, or even at least 4:1 and up to and including 15:1.

These formulations can be applied to the support using any useful technique including coating with appropriate equipment and conditions, including but not limited to hopper coating, curtain coating, rod coating, gravure coating, roller coating, dip coating, and spray coating. The support materials are described above, but before applying the aqueous coatable dye-receiving layer formulation, the support can be treated to improve adhesion using any suitable technique such as acid etching, flame treatment, corona discharge treatment, or glow discharge treatment, or it can be treated with a suitable primer layer.

Then, an overcoat layer was prepared by applying an aqueous coatable dye-receiving image receiving layer formulation comprising an additional surfactant and conductive polymer to the aqueous coatable dye-receiving layer described herein (or as described in (A)) at least on one side of a support coated with an aqueous coatable dye-receiving layer, and in some embodiments, the same or different aqueous coatable dye-receiving layer formulations comprising additional surfactant and a conductive polymer can be applied to opposing sides of a support coated with an aqueous coatable dye-receiving layer to provide a duplex thermal image receiving element.

The applied aqueous coatable overcoat layer formulation comprises a polymer binder composition that consists essentially of the (1) water-dispersible acrylic polymer, (2) water-dispersible polyester, and (3) water-dispersible conductive polymeric material components described herein and additional surfactants, and optional addenda such as a surfactant used in the emulsification of the water-dispersible acrylic polymer, one or more release agents, one or more crosslinking agents, and any other addenda described herein. The weight ratio of the water-dispersible acrylic polymer to the water-dispersible polyester in such formulations is at least 1:1 to and including 6:1, or typically at least 1.5:1 to and including 5:1. Preferably the weight ratio of the water-dispersible acrylic polymer to the water-dispersible polyester in such formulations is at least 1:1 to and including 9.2:1. In certain embodiments, the one or more water-dispersible acrylic polymers are present in the polymer binder matrix at a dry ratio to the water-dispersible polyester of at least 1:1, or typically at least 4:1 and up to and including 20:1, or more likely at least 1:1 and up to and including 20:1, or even at least 4:1 and up to and including 15:1.

The amount of water dispersible conductive polymeric material is as discussed above. The amount of additional surfactant added to the formulation is as discussed above.

These formulations can be applied to the support using any useful technique including coating with appropriate equipment and conditions, including but not limited to hopper coating, curtain coating, rod coating, gravure coating, roller coating, dip coating, and spray coating. The support materials are described above, but before applying the aqueous coatable dye-receiving layer formulation, the support can be treated to improve adhesion using any suitable technique such as acid etching, flame treatment, corona discharge treatment, or glow discharge treatment, or it can be treated with a suitable primer layer.

After the formulation is applied as described in (A) to (D) above, it is dried under suitable conditions of at least 20° C. and up to and including 100° C., and typically at a temperature of at least 60° C. Drying can be carried out in an oven or drying chamber if desired, especially in a manufacturing apparatus or production line. Drying facilitates in the crosslinking of the aqueous image receiving layer formulation and especially through the reactive groups in the water-dispersible acrylic polymer using the appropriate crosslinking agent. Crosslinking can improve the adhesion of the aqueous coatable dye-receiving layer to the support or any immediate layer that is disposed below the aqueous coatable dye-receiving layer.

If desired, after the aqueous coatable dye-receiving layer formulation is dried, it can be treated to additional heating to enhance the crosslinking of at least some of the water-dispersible acrylic polymer, and this heat treatment can be carried out in any suitable manner with suitable equipment such as an oven, at a temperature of at least 70° C. for as long as necessary to remove at least 95% of the water in the aqueous coatable dye-receiving layer formulation.

While the aqueous coatable dye-receiving layer formulation is generally applied to the support in a uniform manner to cover most or the entire support surface, sometimes it is applied to the support and dried in a manner to form a predetermined pattern of the aqueous coatable dye-receiving layer.

While the aqueous coatable dye-receiving layer formulation can be applied directly to either or both sides of the support, in some embodiments, one or more intermediate layers formulation can be applied directly to one or both sides of the support to provide one or more intermediate layers as described above. Once the one or more intermediate layer formulations are applied and dried to form one or more intermediate layers, the aqueous coatable dye-receiving layer formulation is then applied to the one or more intermediate layers on one or both sides of the support. For example, an intermediate layer can be coated out of a suitable formulation to provide cushioning, thermal insulation, antistatic properties, or other desirable properties to enhance manufacturability, element stability, thermal image transfer, and image stability.

The intermediate layer formulations are also generally applied as aqueous compositions in which the various polymeric components and any fillers, surfactants, antistatic agents, and other desirable components are dispersed or dissolved in water or a water/alcohol solvent. As noted above, the intermediate layer formulations can be applied using any suitable technique.

Thermal Donor Elements

Thermal donor elements can be used with the thermal image receiver element of this invention to provide the thermal transfer of dye, clear polymeric films, or metallic effects. Such thermal donor elements generally comprise a support having thereon an ink or dye containing layer (sometimes known as a thermal dye donor layer), a thermally transferable polymeric film, or a layer of metal particles or flakes.

Any ink or dye can be used in thermal donor elements provided that it is transferable to the dry image receiving layer of the thermal image receiver element by the action of heat. Thermal donor elements are described, for example, in U.S. Pat. No. 4,916,112 (Henzel et al.), U.S. Pat. No. 4,927,803 (Bailey et al.), and U.S. Pat. No. 5,023,228 (Henzel) that are all incorporated herein by reference. In a thermal dye transfer method of printing, a thermal donor element can be used that comprises a poly(ethylene terephthalate) support coated with sequential repeating areas (for example, patches) of cyan, magenta, or yellow ink or dye, and the ink or dye transfer steps can be sequentially performed for each color to obtain a multi-color ink or dye transfer image on either or both sides the thermal image receiver element. The support can include a black ink for labeling, identification, or text.

A thermal donor element can also include a clear protective layer ("laminate") that can be thermally transferred onto the thermal image receiver elements, either over the transferred dye images or in non-dyed portions of the thermal image receiver element. When the process is performed using only a single color, then a monochrome ink or dye transfer image can be obtained.

Thermal donor elements conventionally comprise a support having thereon a dye containing layer. Any dye can be used in the dye containing layer provided that it is transferable to the dry image receiving layer by the action of heat.

Thermal donor element can include a single color area (patch) or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include a magenta dye combination and further comprise a yellow dye-donor patch comprising at least one bis-pyrazolone-methine dye and at least one other pyrazolone-methine dye, and a cyan dye-donor patch comprising at least one indoaniline cyan dye. A dye can be selected by taking into consideration hue, lightfastness, and solubility of the dye in the dye-containing layer binder and the aqueous coatable dye-receiving layer binder.

Further examples of useful dyes can be found in U.S. Pat. No. 4,541,830 (Hotta et al.); U.S. Pat. No. 4,698,651 (Moore et al.); U.S. Pat. No. 4,695,287 (Evans et al.); U.S. Pat. No. 4,701,439 (Evans et al.); U.S. Pat. No. 4,757,046 (Byers et al.); U.S. Pat. No. 4,743,582 (Evans et al.); U.S. Pat. No. 4,769,360 (Evans et al.); U.S. Pat. No. 4,753,922 (Byers et al.); U.S. Pat. No. 4,910,187 (Sato et al.); U.S. Pat. No. 5,026,677 (Vanmaele); U.S. Pat. No. 5,101,035 (Bach et al.); U.S. Pat. No. 5,142,089 (Vanmaele); U.S. Pat. No. 5,374,601 (Takiguchi et al.); U.S. Pat. No. 5,476,943 (Komamura et al.); U.S. Pat. No. 5,532,202 (Yoshida); U.S. Pat. No. 5,635,440 (Eguchi et al.); U.S. Pat. No. 5,804,531 (Evans et al.); U.S. Pat. No. 6,265,345 (Yoshida et al.); and U.S. Pat. No. 7,501,382 (Foster et al.), and U.S. Patent Application Publications 2003/0181331 (Foster et al.) and 2008/0254383 (Soejima et al.), the disclosures of which are hereby incorporated by reference.

The dyes can be employed singly or in combination to obtain a monochrome dye-donor layer or a black dye-donor layer. The dyes can be used in the donor transfer element in an amount to provide, upon transfer, from 0.05 $g/m^2$ to and including 1 $g/m^2$ in the eventual dye image.

The dyes and optional addenda are generally incorporated into suitable binders in the dye-containing layers. Such binders are well known in the art and can include cellulose polymers, polyvinyl acetates of various types, polyvinyl butyral, styrene-containing polyol resins, and combinations thereof, and others that are described for example in U.S. Pat. No. 6,692,879 (Suzuki et al.), U.S. Pat. No. 8,105,978 (Yoshizawa et al.) and U.S. Pat. No. 8,114,813 (Yoshizawa et al.), U.S. Pat. No. 8,129,309 (Yokozawa et al.), and U.S. Patent Application Publications 2005/0227023 (Araki et al.) and 2009/0252903 (Teramae et al.), all of which are incorporated herein by reference.

The dye-containing layers can also include various addenda such as surfactants, antioxidants, UV absorbers, or non-transferable colorants in amounts that are known in the art. For example, useful antioxidants or light stabilizers are described for example in U.S. Pat. No. 4,855,281 (Byers) and U.S. Patent Application Publications 2010/0218887 and 2011/0067804 (both of Vreeland) that are incorporated herein by reference. The N-oxyl radicals derived from hindered amines described in the Vreeland publications are particularly useful as light stabilizers for thermal transferred dye images, both in the transferred dye layers and in protective overcoats applied to the transferred dye images.

Polymeric films ("laminates") can be thermally transferred from the donor transfer element to the thermal image receiver element. The compositions of such polymeric films are known in the art as described for example U.S. Pat. No. 6,031,556 (Tutt et al.) and U.S. Pat. No. 6,369,844 (Neumann et al.) that are incorporated herein by reference. The two Vreeland publications described above provide descriptions of protective polymeric films, their compositions, and uses.

In some embodiments, the thermal donor elements comprise a layer of metal or metal salt that can be thermally transferred to the thermal image receiver elements. Such metals can provide metallic effects, highlights, or undercoats for later transferred dye images. Useful metals that can be transferred include but are not limited to, gold, copper, silver, aluminum, and other as described below. Such thermal donor elements are described for example, in U.S. Pat. No. 5,312,683 (Chou et al.) and U.S. Pat. No. 6,703,088 (Hayashi et al.) both of which are incorporated herein by reference.

The backside of thermal donor elements can comprise a "slip" or "slipping" layer as described for example, in the Vreeland publications noted above.

Imaging Assemblies and Thermal Imaging

The thermal image receiver element can be used in an assembly of this invention in combination or "thermal association" with one or more thermal donor elements to provide a thermal transfer or image (for example dye, metal, or clear film) on one or more sides using thermal transfer means. Multiple thermal transfers to the same side, opposing side, or both sides of a thermal image receiver element can provide a multi-color image, polymeric film, or metal image on one or both sides of the substrate of the thermal image receiver element. As noted above, a metal layer or pattern can be formed on one or both sides of the substrate. In addition, a protective polymeric film (topcoat) can also be applied to one or both sides of the substrate, for example to cover a multicolor image on one or both sides of the substrate with a protective overcoat or "laminate".

Thermal transfer generally comprises imagewise-heating a thermal donor element and the thermal image receiver element of this invention and transferring a dye, metal, or clear film image to a thermal image receiver element as described above to form the dye, metal, or polymeric film image. Thus, in some embodiments, both a dye image and polymeric film are imagewise transferred from one or more thermal donor elements to the aqueous coatable dye-receiving layer of the thermal image receiver element.

A thermal dye donor element can be employed which comprises a poly(ethylene terephthalate) support coated with sequential repeating areas of cyan, magenta, and yellow dyes (optionally black dyes or pigments), and the dye transfer steps are sequentially performed for each color to obtain a three-color (or four-color) dye transfer image on either or both sides of the support of the thermal image receiver element. Thermal transfer of a polymeric film can also be achieved in the same or different process to provide a protective overcoat on either or both sides of the support. As noted above, the thermal donor element can also be used to transfer a metal to either or both sides of the thermal image transfer element.

Thermal printing heads that can be used to transfer ink, dye, metal, or a polymeric film from thermal donor elements to the thermal image receiver element are available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for transfer can be used, such as lasers as described in, for example, GB Publication 2,083,726A that is incorporated herein by reference.

An imaging assemblage generally comprises (a) a thermal donor element, and (b) a thermal image receiver element of this invention in a superposed relationship with the thermal donor element, so that the dye-containing layer, polymeric film, or metal of the thermal donor element is in thermal association or intimate contact with the aqueous coatable dye-receiving layer. Imaging can be carried out using this assembly using known processes.

When a three-color image is to be obtained, the imaging assembly can be formed on three different occasions during the time when heat can be applied by the thermal printing head or laser. After the first dye is transferred from a first thermal donor element, the elements can be peeled apart. A second thermal donor element (or another area of the same thermal donor element with a different dye area) can be then brought in register with the aqueous coatable dye-receiving layer and the process is repeated. A third or more color images can be obtained in the same manner. A metal layer (or pattern) or clear laminate protective film can be obtained in the same manner.

The imaging method can be carried out using either a single-head printing apparatus or a dual-head printing apparatus in which either head can be used to image one or both sides of the support. A duplex thermal image receiver element of this invention can be transported in a printing operation using capstan rollers before, during, or after forming the image. In some instances, a duplex thermal image receiver element is disposed within a rotating carousel that is used to position either side of the duplex thermal image receiver element in relationship with the printing head for imaging. In this manner, a clear film a metal pattern or layer can be transferred to either or both sides, along with the various transferred color images.

Duplex thermal image receiver elements of this invention can also receive a uniform or pattern-wise transfer of a metal including but not limited to, aluminum, copper, silver, gold, titanium nickel, iron, chromium, or zinc onto either or both sides of the substrate. Such metalized "layers" can be located over a single- or multi-color image, or the metalized layer can be the only "image". Metal-containing particles can also be transferred. Metals or metal-containing particles can be transferred with or without a polymeric binder. For example, metal flakes in a thermally softenable binder can be transferred as described for example in U.S. Pat. No. 5,312,683 (noted above). The transfer of aluminum powder is described in U.S. Pat. No. 6,703,088 (noted above). Multiple metals can be thermally transferred if desired to achieve a unique metallic effect. For example, one metal can be transferred to form a uniform metallic layer and a second metal is transferred to provide a desired pattern on the uniform metallic layer. Metals or metal-containing particles for transfer can be provided in ribbons or strips of such materials in a thermal donor element.

The following Examples are provided to illustrate the practice of this invention and are not meant to be limiting in any manner Preparation of Copolymers of the Water Dispersible Acrylic Polymer Various copolymers were prepared for evaluation in the thermal image receiver elements, and these copolymers were prepared using the following procedure and components. An emulsion of ethylenically unsaturated polymerizable monomers was prepared with the following composition:

| Monomer emulsion: | |
|---|---|
| Monomers (TABLE I) | 400 g |
| Water | 395 g |
| Rhodocal ® A-246L surfactant (Solvay Rhodia) | 5 g |
| Reactor Contents: | |
| Water | 195 g |
| Rhodocal ® A-246L surfactant | 5 g |
| 45% KOH | 1.54 g |
| "ACVA" | 2 g |

The polymerization procedure was carried out as follows:

1) Add water and Rhodocal® A-246L surfactant to the reactor and heat the mixture to 75° C.

2) Prepare the emulsion using the ethylenically unsaturated polymerizable monomers shown below in TABLE I with starting mol % for each monomer.

3) Add the azobiscyanovaleric acid (ACVA) free radical initiator and the 45 weight % potassium hydroxide to the reactor.

4) Meter the monomer emulsion into the reactor over 6 hours.

5) Maintain the reaction mixture at 75° C. for another 3 hours, and then cool the reaction mixture to 25° C.

6) Adjust the reaction mixture to desire pH using 1N KOH.

TABLE I

Monomer Ratios Used in Making Water-Dispersible Acrylic Polymer in mol %

| Emulsion | Benzyl Meth-acrylate | Styrene | Butyl Acrylate | Butyl Meth-acrylate | Benzyl Acrylate | Meth-acrylic acid | Acrylic Acid | Phenoxy-ethyl acrylate | Isobornyl Meth-acrylate | Cyclohexyl acrylate | Methyl Meth-acrylate |
|---|---|---|---|---|---|---|---|---|---|---|---|
| 1 | 84.4 | 0.0 | 11.7 | 0.0 | 0.0 | 3.9 | 0.0 | 0.0 | 0.0 | 0.0 | 0.0 |
| 2 | 43.7 | 0.0 | 0.0 | 50.9 | 0.0 | 5.4 | 0.0 | 0.0 | 0.0 | 0.0 | 0.0 |
| 3 | 0.0 | 63.8 | 31.1 | 0.0 | 0.0 | 5.1 | 0.0 | 0.0 | 0.0 | 0.0 | 0.0 |
| 4 | 87.5 | 0.0 | 10.6 | 0.0 | 0.0 | 2.0 | 0.0 | 0.0 | 0.0 | 0.0 | 0.0 |
| 5 | 51.3 | 0.0 | 0.0 | 46.9 | 0.0 | 1.8 | 0.0 | 0.0 | 0.0 | 0.0 | 0.0 |
| 6 | 0.0 | 70.0 | 28.0 | 0.0 | 0.0 | 1.9 | 0.0 | 0.0 | 0.0 | 0.0 | 0.0 |
| 7 | 9.8 | 68.6 | 18.9 | 0.0 | 0.0 | 2.7 | 0.0 | 0.0 | 0.0 | 0.0 | 0.0 |
| 8 | 7.9 | 62.3 | 27.1 | 0.0 | 0.0 | 2.7 | 0.0 | 0.0 | 0.0 | 0.0 | 0.0 |
| 9 | 7.8 | 62.0 | 27.0 | 0.0 | 0.0 | 0.0 | 3.2 | 0.0 | 0.0 | 0.0 | 0.0 |
| 10 | 0.0 | 65.4 | 23.0 | 0.0 | 8.4 | 0.0 | 3.1 | 0.0 | 0.0 | 0.0 | 0.0 |
| 11 | 0.0 | 70.7 | 0.0 | 0.0 | 0.0 | 2.9 | 0.0 | 26.4 | 0.0 | 0.0 | 0.0 |
| 12 | 0.0 | 71.9 | 0.0 | 0.0 | 0.0 | 0.0 | 3.5 | 24.7 | 0.0 | 0.0 | 0.0 |
| 13 | 0.0 | 61.0 | 18.4 | 0.0 | 17.4 | 0.0 | 3.3 | 0.0 | 0.0 | 0.0 | 0.0 |
| 14 | 76.6 | 0.0 | 0.0 | 0.0 | 18.7 | 0.0 | 4.7 | 0.0 | 0.0 | 0.0 | 0.0 |
| 15 | 0.0 | 66.4 | 0.0 | 0.0 | 0.0 | 3.0 | 0.0 | 30.6 | 0.0 | 0.0 | 0.0 |
| 16 | 0.0 | 67.7 | 0.0 | 0.0 | 0.0 | 0.0 | 3.6 | 28.7 | 0.0 | 0.0 | 0.0 |
| 17 | 76.1 | 0.0 | 0.0 | 0.0 | 0.0 | 0.0 | 4.8 | 19.0 | 0.0 | 0.0 | 0.0 |
| 18 | 0.0 | 0.0 | 0.0 | 0.0 | 0.0 | 0.0 | 3.6 | 33.9 | 0.0 | 0.0 | 62.5 |
| 19 | 0.0 | 65.2 | 0.0 | 0.0 | 31.4 | 0.0 | 3.4 | 0.0 | 0.0 | 0.0 | 0.0 |
| 20 | 49.4 | 0.0 | 0.0 | 0.0 | 0.0 | 0.0 | 4.5 | 0.0 | 0.0 | 46.1 | 0.0 |
| 21 | 47.8 | 0.0 | 0.0 | 0.0 | 0.0 | 3.8 | 0.0 | 0.0 | 0.0 | 48.4 | 0.0 |
| 22 | 0.0 | 0.0 | 0.0 | 0.0 | 0.0 | 0.0 | 5.4 | 59.2 | 35.3 | 0.0 | 0.0 |

The following TABLE II describes the chemical properties of the water-dispersible acrylic polymers (as emulsions) that were prepared using the ethylenically unsaturated polymerizable monomers shown in TABLE I.

TABLE II

| Emulsion Copolymer | $T_g$ | Average Latex Particle Size (nm) | Mole % Aromatic Recurring Units | pH | Emulsion % Solids |
|---|---|---|---|---|---|
| E-1 | 54.9 | 95.8 | 84.4 | 8.0 | 37.9 |
| E-2 | 51.2 | 100.3 | 43.7 | 8.0 | 38.9 |
| E-3 | 49.3 | 81.9 | 63.8 | 8.0 | 38.4 |
| E-4 | 55.4 | 98.1 | 87.5 | 8.0 | 40.4 |
| E-5 | 49.9 | 107.8 | 51.3 | 8.0 | 40.3 |
| E-6 | 50.6 | 85.4 | 70.0 | 8.0 | 39.4 |
| E-7 | 62.8 | 82.4 | 78.4 | 8.0 | 39.4 |
| E-8 | 50.3 | 81.2 | 70.2 | 8.0 | 39.0 |
| E-9 | 46.8 | 81.7 | 69.8 | 8.0 | 37.0 |
| E-10 | 50.2 | 80.6 | 73.8 | 7.4 | 36.7 |
| E-11 | 58.5 | 85.7 | 97.1 | 7.4 | 38.3 |
| E-12 | 58.5 | 87.9 | 96.5 | 7.4 | 37.9 |
| E-13 | 43.6 | 77.3 | 74.6 | 7.4 | 36.5 |
| E-14 | 53.1 | 102 | 95.3 | 7.4 | 38.6 |
| E-15 | 53.5 | 82.7 | 97.0 | 7.4 | 38.4 |
| E-16 | 56.2 | 81.4 | 96.4 | 7.4 | 37.3 |
| E-17 | 47.8 | 110.4 | 95.2 | 7.4 | 39.4 |
| E-18 | 46.2 | 83.7 | 33.9 | 7.4 | 37.0 |
| E-19 | 60.9 | 87.2 | 96.6 | 7.4 | 38.4 |
| E-20 | 50.8 | 95.8 | 49.4 | 7.4 | 38.5 |
| E-21 | 51.7 | 88.7 | 47.8 | 7.4 | 37.5 |
| E-22 | 42.2 | 89.5 | 59.2 | 7.4 | 38.1 |
| E-23 | 54.3 | 82.1 | 52.4 | 7.4 | 36.8 |
| E-24 | 56.3 | 92.3 | 49.7 | 7.4 | 37.6 |
| E-25 | 61.8 | 83.1 | 79.3 | 7.4 | 37.8 |
| E-26 | 65.7 | 91.1 | 54.9 | 7.4 | 38.2 |

EXAMPLES

Formation of Thermal Image Receiver Elements

All of the Control Examples and Invention Examples I1 through I58 were prepared using aqueous image receiving layer formulations that were designed to provide a dye image receiving layer having a dry coverage of 2.2 g/m$^2$. For Invention Examples I59 through I73, the aqueous image receiving layer formulations were designed to provide image receiving layers having a dry coverage of 1.1 g/m$^2$. In addition, all aqueous image receiving layer formulations was designed to have about 10% solids that would include all of the solid components shown for each formulation in TABLE III below.

For the Control C1 formulation, all of the solids were the water-dispersible polyester (Vylonal® MD-1480, provided as 25 weight % dispersion in water from Toyobo®) that provided 100% of the solids in the resulting dye image receiving layer. The Control C1 image receiving layer formulation was prepared by dispersing only the water-dispersible polyester in water with brief stirring, and the Control C2 image receiving layer formulation was similarly prepared with 98% solids of the same water-dispersible polyester dispersion as well as 2% solids of the release agent (Siltech® E2150).

To prepare the Control formulations C3 to C31 and Invention formulations I1 to I29, the release agent (35 weight % dispersion) was diluted with about 258 g of water, and then the acrylic polymer emulsion (see TABLE II for % solids) was added to this mixture, with brief stirring. The Control formulations C3 to C31 contained no water-dispersible polyesters.

For each of the Invention formulations I1 through I29, the resulting image receiving layer comprised 30 weight % of the water-dispersible polyester (Vylonal® MD-1480, provided as 25 weight % dispersion in water from Toyobo®), 67 weight % of the acrylic polymer, and 3 weight % of the release agent (Siltech® E2150, provided as 35 weight % dispersion in water from Siltech).

For each of the Invention formulations I30 through I58, the resulting image receiving layer comprised 30 weight % of the water-dispersible polyester (Vylonal® MD-1480, provided as 25 weight % dispersion in water from Toyobo®), 64 weight % of the acrylic polymer, 4 weight % of the crosslinking agent (carbodiimide XL-1, provided as 40 weight % dispersion in water from DSM), and 2 weight % of the release agent (Siltech® E2150). To prepare the Invention formulations I30 to I58, the release agent (35 weight % dispersion) was diluted with about 243 g of water, and then about 42 g the polyester dispersion (25 weight % dispersion) was added to this mixture, followed by addition of the acrylic polymer (see TABLE II for % solids) and carbodiimide crosslinking agent XL-1 (40 weight % dispersion), with brief stirring.

For each of Invention Formulations I59 through I73, the resulting image receiving layer comprised 15 weight % of the water-dispersible polyester (Vylonal® MD-1480, provided as 25 weight % dispersion in water from Toyobo®), 32 weight % of the acrylic polymer, 1 weight % of the crosslinking agent (carbodiimide XL-1, provided as 40 weight % dispersion in water from DSM), and 1 weight % of the release agent (Siltech® E2150).

Each dye image receiving layer formulation was machine coated onto a sample of substrate comprising microvoided layers on opposing sides of a paper stock base (such as KTS-107 laminate that is available from HSI, South Korea) and dried to provide the 2.2 (or 1.1) g/m$^2$ dry coverage for the resulting dry image receiving layer. There was no intermediate layer between the support and the dry image receiving layer for any of the thermal image receiving elements.

For each of Invention Formulations I74 and I75, the resulting image receiving layer comprised 9 and 6.8 weight % of the water-dispersible polyester (Vylonal® MD-1480, provided as 25 weight % dispersion in water from Toyobo®), 80.8 and 81.2 weight % of the acrylic polymer, 9 and 11 weight % of the crosslinking agent (carbodiimide XL-1, provided as 40 weight % dispersion in water from DSM), and 1.2 and 1 weight % of the release agent (Siltech® E2150), respectively.

Each dye image receiving layer formulation was machine coated onto a sample of substrate comprising microvoided layers on opposing sides of a paper stock base (such as ExxonMobil Vulcan laminate that is available from ExxonMobil, USA) and dried to provide the 1.32 g/m$^2$ dry coverage for the resulting dry image receiving layer. There was no intermediate layer between the support and the dry image receiving layer for any of the thermal image receiving elements.

Each of the Control and Invention dye image receiving layer formulations and resulting thermal image receiver element were evaluated for various properties in the following manner.

Coating Quality

Coating quality was visually evaluated (without magnification) and given one of three ratings. A visual rating of "poor" means that the coated and dried image receiving layer was not uniform as coating lines were visible and reticulation (mottle) was very prominent. A visual rating of "OK" means some coating lines and reticulation were evident but the dry image receiving layer quality was acceptable. A visual evaluation of "Good" means that the dry image receiving layer was very uniformly glossy and smooth with no visibly noticeable coating lines or reticulation.

Donor-Receiver Sticking

The donor-receiver sticking quality was visually evaluated (without magnification) after "printing" or forming the thermal assembly of donor element and thermal image receiver element. An evaluation of "poor" means that the dye donor layer in the donor element generally delaminated from the donor element support during thermal dye transfer (printing). An evaluation of "OK" means that dye donor layer did not delaminate from the donor element support, but there was chattering noise in the printer and some chatter lines in some of the resulting thermally transferred dye images. An evaluation of "Good" means that no sticking defects were evident in the resulting thermally transferred dye images.

Grey-Scale Transition

A smooth gradual transition of optical density is critical for a quality highlight print. Therefore, a measure of grey-scale transition at a low optical density region, such as, in the situation of a highlight printing, was visually evaluated (without magnification) by determining the density continuity over 18 incremental optical density steps from minimum density ($D_{min}$, or energy step 18) to maximum density ($D_{max}$>1.5 or energy step 1) and at which step (step x) the particular image was lost or discontinuity in optical density was observed, which can also be illustrated effectively in a sensitometric curves, that is, optical density vs. energy steps, and the associated sensitometric data.

An evaluation of "Poor" means that a difference in optical density, that is, ΔOD<0.015 between step x and step 18 (or $D_{min}$), or a least-square slope that is <0.002 (absolute value) based on the sensitometric curve between step x and step 18 (or $D_{min}$), was obtained. An evaluation of "OK" means that an optical density difference (ΔOD) of at least 0.010 to 0.058 between step x and step 18 (or $D_{min}$), or a least-square slope at least 0.002 to 0.006 (absolute value) based on the sensitometric curve between step x and step 18 (or $D_{min}$), was obtained. An evaluation of "Good" means that a difference in optical density, i.e., ΔOD>0.042 between step x and step 18 (or $D_{min}$), or a least-square slope>0.006 (absolute value) based on the sensitometric curve between step x and step 18 (or $D_{min}$), was obtained.

$D_{max}$ of Neutral (Red, Green, or Blue of Neutral)

As used in the practice of this invention, $D_{max}$ of Neutral is a measure of an aim maximum optical density of a neutral hue that can be obtained from an imaged thermal print using a given set of dye donor elements, thermal image receiver elements, and thermal printing conditions. Since the aim neutral hue, $D_{max}$ of Neutral, is composed of a composite of the thermally transferred yellow, magenta, and cyan dyes from respective color dye donor element patches, the optical density of the respective color dye, that is $D_{max}$ (Red of Neutral), $D_{max}$ (Green of Neutral), and $D_{max}$ (Blue of Neutral), can be obtained separately in the printed thermal images using a Gretag Macbeth SpectroScan machine. In the results shown below in TABLE III, the smaller absolute values are better because they show a smaller deviation of the image color from the aim optical density at $D_{max}$, and the color images are thus closer to that aim optical density.

The results of these evaluations are provided below in TABLE III. It is apparent from these results that while the Control formulations and thermal image receiver elements provided some good qualities, they did not consistently provide all of the desired properties. However, the Invention formulations and thermal image receiver elements provided desired results for most if not all of the needed properties.

In particular, it is apparent that when the film-forming polyester is not present, the coating quality (as a result of film-forming property) and overall print (image) performance such as donor-receiver sticking, print uniformity, and dye transfer efficiency (such as $D_{max}$) as listed in TABLE III below usually deteriorated and became less desirable as a high quality color image. For example, when comparisons are made among Controls C3-C5, Inventions I1-I3, and Inventions I30-32, the coating quality and donor-receiver sticking performances were poor for the Controls as compared to the Invention examples. In comparisons made among Controls C8-23 and C-28, Inventions I6-I18, and Inventions I25-I50, all of the examples demonstrated good donor-receiver sticking properties but the $D_{max}$ values of the Control examples were noticeably worse than the $D_{max}$ values of the Invention examples.

When the acrylic latex was not present (Controls C1 and C2), the donor ribbon (element) did not separate easily during the thermal printing process and it usually stuck tightly to the thermal image receiving element, causing serious printing and print quality problems. In addition, the image receiving layer of Control C1 tended to adhere to the opposite side of the thermal image receiver element, particularly when it was in roll form or in cut sheet stacked format.

A comparison of Control C1 (no release agent) and Control C2 (release agent) indicates that the presence of a water-dispersible release agent in the image receiving layer formulation reduces sticking of the donor element to the thermal image receiver element during the thermal printing process.

When a crosslinking agent was present in the dye image receiving layer formulations, the donor-receiver sticking problem (improved the donor-receiver release property) was reduced such that less release agent was required in the image receiving layer, which in turn helps promote an improved adhesion between the clear laminate protective film and the image receiving layer, which is a desirable property.

TABLE III

| Thermal Image Receiver Element | Acrylic Polymer Latex | Polyester Resin? * | Coating Quality | Donor-Receiver Sticking | Grey Scale Transition/ Neutral) | $D_{max}$ (Red of Neutral) | $D_{max}$ (Green of Neutral) | $D_{max}$ (Blue of |
|---|---|---|---|---|---|---|---|---|
| C1 | None | Yes | Good | Poor | NA | NA | NA | NA |
| C2 | None | Yes | Good | OK | NA | NA | NA | NA |
| C3 | DSM NeoCryl ™ A-6092 | No | Poor | Poor | NA | NA | NA | NA |
| C4 | DSM NeoCryl ™ A-6015 | No | Poor | Poor | NA | NA | NA | NA |
| C5 | DSM NeoCryl ™ XK-220 | No | Poor | Poor | NA | NA | NA | NA |
| I1 | DSM NeoCryl ™ 6092 | Yes | Good | Good | Good | −12% | −24% | −26% |
| I2 | DSM NeoCryl ™ 6015 | Yes | Good | Good | Good | −11% | −22% | −25% |
| I3 | DSM NeoCryl ™ XK-220 | Yes | Good | Good | Good | −10% | −20% | −22% |
| I30 | DSM NeoCryl ™ 6092 | Yes | Good | Good | Good | −12% | −23% | −24% |
| I31 | DSM NeoCryl ™ 6015 | Yes | Good | Good | Good | −10% | −19% | −21% |
| I32 | DSM NeoCryl ™ XK-220 | Yes | Good | Good | Good | −11% | −21% | −23% |
| C10 | E-5 | No | Poor | Good | Poor | −11% | −21% | −26% |
| C12 | E-7 | No | Poor | Good | Poor | −10% | −19% | −21% |
| I8 | E-5 | Yes | Good | Good | Poor | −10% | −17% | −22% |
| I10 | E-7 | Yes | Good | Good | Poor | −6% | −12% | −14% |
| I37 | E-5 | Yes | OK | Good | Poor | −9% | −15% | −19% |
| I39 | E-7 | Yes | OK | Good | Poor | −8% | −13% | −13% |
| C6 | E-1 | No | Poor | OK | Poor | −9% | −14% | −18% |
| C7 | E-2 | No | OK | Poor | NA | NA | NA | NA |
| C8 | E-3 | No | OK | OK | Good | −11% | −20% | −20% |
| C9 | E-4 | No | OK | Good | Good | −6% | −11% | −16% |
| C10 | E-5 | No | Poor | Good | Poor | −11% | −21% | −26% |
| C11 | E-6 | No | OK | Good | Poor | −12% | −21% | −21% |
| C12 | E-7 | No | Poor | Good | Poor | −10% | −19% | −21% |
| C13 | E-8 | No | Poor | Good | Poor | −10% | −16% | −16% |
| C14 | E-9 | No | OK | Good | OK | −10% | −16% | −15% |
| C15 | E-10 | No | OK | Good | OK | −7% | −14% | −13% |
| C16 | E-11 | No | Poor | Good | Poor | −5% | −8% | −10% |
| C17 | E-12 | No | Good | Good | OK | −3% | −7% | −10% |
| C18 | E-13 | No | Good | Good | Good | −4% | −7% | −9% |
| C19 | E-14 | No | Good | Good | OK | −2% | −6% | −13% |
| C20 | E-15 | No | OK | Good | OK | −4% | −6% | −8% |
| C21 | E-16 | No | OK | Good | OK | −4% | −6% | −8% |
| C22 | E-17 | No | Good | Good | OK | −3% | −6% | −11% |
| C23 | E-18 | No | Poor | Good | OK | −7% | −13% | −18% |
| C24 | E-19 | No | Poor | Good | OK | −5% | −11% | −12% |
| C25 | E-20 | No | Poor | Good | OK | −8% | −18% | −20% |
| C26 | E-21 | No | Poor | Good | OK | −8% | −18% | −20% |
| C27 | E-22 | No | Poor | Poor | NA | −9% | −12% | −12% |
| C28 | E-23 | No | Poor | Good | OK | −4% | −7% | −9% |
| C29 | E-24 | No | Poor | Poor | NA | −9% | −19% | −21% |
| C30 | E-25 | No | Good | Good | Good | −8% | −17% | −16% |
| C31 | E-26 | No | Good | Good | Poor | −9% | −21% | −24% |
| I4 | E-1 | Yes | Good | Good | Good | −6% | −9% | −13% |
| I5 | E-2 | Yes | Good | Good | Good | −8% | −16% | −19% |
| I6 | E-3 | Yes | Good | Good | Good | −8% | −14% | −15% |
| I7 | E-4 | Yes | Good | Good | Good | −6% | −8% | −13% |
| I9 | E-6 | Yes | Good | Good | Good | −11% | 17% | −18% |
| I11 | E-8 | Yes | Good | Good | Good | −7% | −10% | −11% |
| I12 | E-9 | Yes | Good | Good | Good | −7% | −12% | −11% |
| I13 | E-10 | Yes | Good | Good | Good | −5% | −10% | −10% |
| I14 | E-11 | Yes | Good | Good | Good | −4% | −6% | −9% |
| I15 | E-12 | Yes | Good | Good | Good | −2% | −5% | −8% |
| I16 | E-13 | Yes | Good | Good | Good | −3% | −5% | −8% |
| I17 | E-14 | Yes | Good | Good | Good | −2% | −4% | −9% |
| I18 | E-15 | Yes | Good | Good | Good | −2% | −4% | −6% |
| I19 | E-16 | Yes | Good | Good | Good | −3% | −5% | −7% |
| I20 | E-17 | Yes | Good | Good | Good | −2% | −5% | −9% |

TABLE III-continued

| Thermal Image Receiver Element | Acrylic Polymer Latex | Polyester Resin? * | Coating Quality | Donor-Receiver Sticking | Grey Scale Transition/ Neutral) | $D_{max}$ (Red of Neutral) | $D_{max}$ (Green of Neutral) | $D_{max}$ (Blue of |
|---|---|---|---|---|---|---|---|---|
| I21 | E-18 | Yes | Good | Good | Good | −6% | −11% | −15% |
| I28 | E-25 | Yes | Good | Good | Good | −4% | −9% | −9% |
| I29 | E-26 | Yes | Good | Good | Good | −5% | −12% | −15% |
| I33 | E-1 | Yes | OK | Good | Good | −5% | −8% | −11% |
| I34 | E-2 | Yes | Good | Good | Good | −8% | −13% | −17% |
| I35 | E-3 | Yes | Good | Good | Good | −11% | −15%- | −15% |
| I36 | E-4 | Yes | OK | Good | Good | −4% | −7% | −10% |
| I38 | E-6 | Yes | OK | Good | Good | −12% | −17% | −17% |
| I40 | E-8 | Yes | OK | Good | Good | −8% | −11% | −10% |
| I41 | E-9 | Yes | Good | Good | Good | −10% | −13% | −10% |
| I42 | E-10 | Yes | Good | Good | Good | −8% | −10% | −8% |
| I43 | E-11 | Yes | OK | Good | Good | −5% | −7% | −8% |
| I44 | E-12 | Yes | Good | Good | Good | −4% | −6% | −8% |
| I45 | E-13 | Yes | Good | Good | Good | −3% | −5% | −5% |
| I46 | E-14 | Yes | Good | Good | Good | −1% | −3% | −8% |
| I47 | E-15 | Yes | OK | Good | Good | −4% | −6% | −7% |
| I48 | E-16 | Yes | Good | Good | Good | −4% | −5% | −5% |
| I49 | E-17 | Yes | Good | Good | Good | −2% | −3% | −6% |
| I50 | E-18 | Yes | Good | Good | Good | −7% | −11% | −13% |
| I51 | E-19 | Yes | Good | Good | Good | −5% | −8% | −8% |
| I52 | E-20 | Yes | Good | Good | Good | −6% | −12% | −13% |
| I53 | E-21 | Yes | Good | Good | Good | −6% | −11% | −14% |
| I54 | E-22 | Yes | Good | Good | Good | −4% | −7% | −7% |
| I55 | E-23 | Yes | Good | Good | Good | −5% | −7% | −6% |
| I56 | E-24 | Yes | Good | Good | Good | −5% | −12% | −13% |
| I57 | E-25 | Yes | Good | Good | Good | −7% | −12% | −9% |
| I58 | E-26 | Yes | Good | Good | Good | −5% | −12% | −14% |
| I59 | E-12 | Yes | Good | Good | Good | −1% | −2% | −3% |
| I60 | E-13 | Yes | Good | Good | Good | −5% | −6% | −5% |
| I61 | E-14 | Yes | Good | Good | Good | −1% | −4% | −6% |
| I62 | E-15 | Yes | Good | Good | Good | −2% | −3% | −2% |
| I63 | E-16 | Yes | Good | Good | Good | −3% | −3% | −2% |
| I64 | E-17 | Yes | Good | Good | Good | −1% | −1% | −2% |
| I65 | E-18 | Yes | Good | Good | Good | −6% | −9% | −10% |
| I66 | E-19 | Yes | Good | Good | Good | −3% | −5% | −4% |
| I67 | E-20 | Yes | Good | Good | Good | −6% | −11% | −10% |
| I68 | E-21 | Yes | Good | Good | Good | −5% | −11% | −10% |
| I69 | E-22 | Yes | Good | Good | Good | −4% | −5% | −4% |
| I70 | E-23 | Yes | Good | Good | Good | −2% | −3% | −2% |
| I71 | E-24 | Yes | Good | Good | Good | −5% | −11% | −9% |
| I72 | E-25 | Yes | Good | Good | Good | −4% | −8% | −5% |
| I73 | E-26 | Yes | Good | Good | Good | −4% | −10% | −8% |

"NA" means the datum is not available because of donor-receiver sticking.

* Vylonal ® MD-1480 by Toyobo ®

The invention claimed is:

1. A conductive thermal image receiver element comprising a support, and having on at least one side of the support:

an aqueous-coatable receiver overcoat layer and aqueous-coatable dye-receiving layer, wherein the aqueous-coatable receiver overcoat layer comprises a conductive polymeric material, a first dispersant, and a second dispersant, and wherein the aqueous-coatable dye-receiving layer comprises a water-dispersible release agent, a crosslinking agent, and a polymer binder matrix consisting essentially of:

(1) a water-dispersible acrylic polymer comprising chemically reacted or chemically non-reacted hydroxyl, phospho, phosphonate, sulfo, sulfonate, carboxy, or carboxylate groups; and (2) a water-dispersible polyester that has a Tg of 30° C. or less;

wherein the water-dispersible acrylic polymer is present in an amount of at least 55 weight % of the total aqueous coatable dye-receiving layer weight and is present at a dry ratio to the water-dispersible polyester of at least 1:1.

2. The conductive thermal image receiver element of claim 1, wherein the first dispersant and the second dispersant are independently selected from the group consisting of (a) a random copolymer; (b) an acrylic block copolymer; and (c) an acrylic block terpolymer.

3. The conductive thermal image receiver element of claim 2, wherein (a) the random copolymer, (b) the acrylic block copolymer, and (c) the acrylic block terpolymer all comprise a hydrophilic constituent and a hydrophobic constituent.

4. The conductive thermal image receiver element of claim 3, wherein the hydrophobic constituent for each of (a) the random copolymer, (b) the acrylic block copolymer, and (c) the acrylic block terpolymer are independently selected from the group consisting of: an aliphatic monomer, an aromatic monomer, an alicyclic monomer, an aromatic heterocycle, an alicyclic heterocycle, and a polycyclic monomer.

5. The conductive thermal image receiver element of claim 2, wherein (a) the random copolymer, (b) the acrylic block copolymer, and (c) the acrylic block terpolymer all have a weight average molecular ranging from 5,000 to 100,000.

6. The conductive thermal image receiver element of claim 2, wherein the first dispersant is a random copolymer comprising benzyl methacrylate and methacrylic acid.

7. The conductive thermal image receiver element of claim 6, wherein the first dispersant is present in an amount ranging from 1% to 4% by weight, based on the total dry weight of the receiver overcoat layer.

8. The conductive thermal image receiver element of claim 6, wherein the second dispersant is an acrylic block copolymer.

9. The conductive thermal image receiver element of claim 8, wherein the second dispersant is present in an amount ranging from 1% to 4% by weight, based on the total dry weight of the receiver overcoat layer.

10. The conductive thermal image receiver element of claim 6, wherein the second dispersant is an acrylic block terpolymer.

11. The conductive thermal image receiver element of claim 10, wherein the second dispersant is present in an amount ranging from 1% to 4% by weight, based on the total dry weight of the receiver overcoat layer.

12. The conductive thermal image receiver element of claim 1, wherein the first dispersant and the second dispersant are cumulatively present in an amount ranging from 0.5 to 10% by weight based on the total dry weight of the receiver overcoat layer.

13. The conductive thermal image receiver element of claim 1, wherein the receiver overcoat layer further comprises at least one surfactant.

14. The conductive thermal image receiver element of claim 13, wherein the at least one surfactant comprises P-isonoylphenoxypoly(glycidol).

15. The conductive thermal image receiver element of claim 1, wherein the conductive polymeric material is Poly (3,4-ethylendioxythiophene)-poly(styrenesulfonate).

16. The conductive thermal image receiver element of claim 1, wherein the thickness of the receiver overcoat layer ranges from 0.1 μm to 0.62 μm.

17. The conductive thermal image receiver element of claim 1, wherein either the first dispersant or the second dispersant is a random terpolymer of benzyl methacrylate, octadecyl methacrylate, and methacrylic acid in an amount ranging from 1% to 4% by weight, based on the total dry weight of the receiver overcoat layer.

18. A method for making the conductive thermal image receiver element of claim 1, comprising:

(A) applying an aqueous coatable dye-receiving layer formulation to one or both opposing sides of a support or to another layer that resides on one or both sides of the support, the aqueous coatable dye-receiving layer formulation comprising a water-dispersible release agent, a crosslinking agent, and a polymer binder composition consisting essentially of:
  (1) a water-dispersible acrylic polymer comprising chemically reacted or chemically non-reacted hydroxyl, phospho, phosphonate, sulfo, sulfonate, carboxy, or carboxylate groups, and
  (2) a water-dispersible polyester that has a Tg of 30° C. or less;
  wherein the water-dispersible acrylic polymer is present in an amount of at least 55 weight % of the resulting total dry image receiving layer weight, and is present in the polymeric binder matrix at a dry ratio to the water-dispersible polyester of at least 1:1 to and including 9.2:1, or at least 4:1 to and including 20:1;

(B) drying the aqueous image receiving layer formulation to form a dry image receiving layer on one or both opposing sides of the support;

(C) applying a receiver overcoat layer to at least on one side of a support coated with an aqueous coatable dye-receiving layer, the receiver overcoat layer comprising a first dispersant, a second dispersant, and a conductive polymeric material; and (D) drying the aqueous image receiving layer formulation to form a dry receiver overcoat layer on one or both opposing sides of the support.

19. The method of claim 18, wherein the same aqueous coatable dye receiving layer formulation and the same receiver overcoat layer are applied to both opposing sides of the support.

* * * * *